US010378861B2

(12) United States Patent
Wadley et al.

(10) Patent No.: US 10,378,861 B2
(45) Date of Patent: Aug. 13, 2019

(54) IMPULSE MITIGATION SYSTEMS FOR MEDIA IMPACTS AND RELATED METHODS THEREOF

(71) Applicant: University of Virginia Patent Foundation, Charlottesville, VA (US)

(72) Inventors: Haydn N. G. Wadley, Keswick, VA (US); Vikram Deshpande, Cambridge (GB)

(73) Assignee: University of Virginia Patent Foundation, Charlottesville, VA (US)

( * ) Notice: Subject to any disclaimer, the term of this patent is extended or adjusted under 35 U.S.C. 154(b) by 0 days.

(21) Appl. No.: 15/508,509

(22) PCT Filed: Sep. 4, 2015

(86) PCT No.: PCT/US2015/048684
§ 371 (c)(1),
(2) Date: Mar. 3, 2017

(87) PCT Pub. No.: WO2016/081048
PCT Pub. Date: May 26, 2016

(65) Prior Publication Data
US 2017/0191802 A1 Jul. 6, 2017

Related U.S. Application Data

(60) Provisional application No. 62/045,736, filed on Sep. 4, 2014.

(51) Int. Cl.
*F41H 5/007* (2006.01)
*F41H 7/04* (2006.01)

(52) U.S. Cl.
CPC ..... *F41H 5/007* (2013.01); *F41H 7/042* (2013.01)

(58) Field of Classification Search
CPC ..... F41H 5/007; F41H 7/042
USPC ..... 89/36.08
See application file for complete search history.

(56) References Cited

U.S. PATENT DOCUMENTS

| | | | |
|---|---|---|---|
| 5,534,314 | A | 7/1996 | Wadley |
| 5,736,073 | A | 4/1998 | Wadley |
| 6,478,931 | B1 | 11/2002 | Wadley |
| 7,014,889 | B2 | 3/2006 | Groves |

(Continued)

FOREIGN PATENT DOCUMENTS

| | | |
|---|---|---|
| WO | WO 98/01596 | 1/1998 |
| WO | WO 99/65626 | 12/1999 |

(Continued)

OTHER PUBLICATIONS

Weiner et al., "Organizational Interests versus Battlefield Needs: The U.S. Military and Mine-Resistant Ambush Protected Vehicles in Iraq", Polity, Oct. 2010, pp. 461-482, vol. 42, No. 4.

*Primary Examiner* — Joshua E Freeman
*Assistant Examiner* — Bridget A Cochran
(74) *Attorney, Agent, or Firm* — Robert J. Decker

(57) ABSTRACT

An impulse mitigation system configured to mitigate blast impulse directed to a surface (or structure or target). The system includes a substrate in communication with the surface (or structure or target), wherein the substrate is configured to receive an impulse directed to the surface (or structure or target) and then relocate from the surface (or structure or target) in response to received impulse.

15 Claims, 24 Drawing Sheets

(56) References Cited

U.S. PATENT DOCUMENTS 7,211,348 B2 5/2007 Wadley
7,288,326 B2 10/2007 Elzey
7,357,062 B2 4/2008 Joynt
7,401,643 B2 7/2008 Queheillalt
7,424,967 B2 9/2008 Ervin
7,669,799 B2 3/2010 Elzey
7,718,222 B2 5/2010 Hass
7,879,411 B2 2/2011 Hass
7,913,611 B2 * 3/2011 Terry ..... F41H 5/0414 89/36.02
7,963,085 B2 6/2011 Sypeck
7,997,182 B1 * 8/2011 Cox ..... F41H 7/042 296/187.07
8,033,208 B2 * 10/2011 Joynt ..... F41H 7/042 296/187.07
8,084,086 B2 12/2011 Hass
8,110,143 B2 2/2012 Rabiei
8,124,178 B2 2/2012 Hass
8,146,477 B2 * 4/2012 Joynt ..... F41H 7/042 296/187.07
8,146,478 B2 * 4/2012 Joynt ..... F41H 7/042 296/187.07
8,176,635 B2 * 5/2012 Queheillalt ..... B21C 23/14 29/897
8,247,333 B2 8/2012 Sypeck
8,360,361 B2 1/2013 Wadley
8,402,878 B2 * 3/2013 Schreiner ..... B60G 3/20 296/187.07
8,424,443 B2 * 4/2013 Gonzalez ..... F41H 7/042 296/187.07
8,616,617 B2 * 12/2013 Sherbeck ..... F41H 7/044 296/187.07
8,640,594 B2 * 2/2014 Treadway ..... F41H 7/042 296/187.07
8,650,756 B2 2/2014 Wadley
8,656,823 B2 * 2/2014 Kaswen ..... F16F 9/06 280/784
8,667,880 B1 * 3/2014 Berman ..... F41H 7/048 89/36.08
8,784,512 B2 7/2014 Wadley
8,826,796 B1 * 9/2014 Gonzalez ..... F41H 7/042 89/36.07
8,943,946 B1 * 2/2015 Richmond ..... F41H 7/044 89/36.02
8,960,772 B2 * 2/2015 Lane ..... B62D 21/10 296/183.1
9,038,523 B2 * 5/2015 Rasico ..... F41H 7/042 89/36.07
9,045,014 B1 * 6/2015 Verhoff ..... B62D 21/152
9,146,080 B2 * 9/2015 Parida ..... F41H 5/007
9,921,037 B2 3/2018 Wadley
2002/0185893 A1 * 12/2002 Hashirayama ..... B60K 13/04 296/204
2003/0054133 A1 3/2003 Wadley
2005/0202206 A1 9/2005 Wadley
2005/0255289 A1 * 11/2005 Wadley ..... B22F 7/002 428/116
2005/0266163 A1 12/2005 Wortman
2005/0287296 A1 12/2005 Wadley
2006/0062912 A1 3/2006 Wortman
2006/0080835 A1 4/2006 Kooistra
2007/0234896 A1 * 10/2007 Joynt ..... F41H 7/042 89/36.09
2007/0269716 A1 11/2007 Wadley
2008/0006353 A1 1/2008 Elzey
2008/0034953 A1 * 2/2008 Barbe ..... F41H 7/042 89/36.01
2008/0066613 A1 * 3/2008 Mills ..... F41H 7/042 89/36.09
2008/0131611 A1 6/2008 Hass
2008/0135212 A1 6/2008 Queheillalt
2009/0274865 A1 11/2009 Wadley
2009/0293712 A1 * 12/2009 Ran ..... B60N 2/24 89/36.08
2010/0104819 A1 4/2010 Wadley
2010/0218667 A1 * 9/2010 Naroditsky ..... F41H 7/042 89/36.02
2010/0236759 A1 9/2010 Wadley
2011/0017054 A1 * 1/2011 Naroditsky ..... F41H 7/042 89/36.02
2011/0072960 A1 * 3/2011 Hallissy ..... F41H 1/02 89/36.02
2011/0109704 A1 5/2011 Queheillalt
2011/0250385 A1 10/2011 Sypeck
2011/0318498 A1 12/2011 Wadley
2012/0137974 A1 6/2012 Hass
2012/0160166 A1 6/2012 Hass
2012/0193940 A1 * 8/2012 Tunis ..... F41H 7/042 296/187.07
2012/0285114 A1 11/2012 Queheillalt
2013/0014916 A1 * 1/2013 Wadley ..... E01C 11/26 165/104.21
2013/0040524 A1 * 2/2013 Halldin ..... B32B 5/022 442/326
2013/0205981 A1 * 8/2013 Bayer ..... F41H 7/042 89/36.02
2013/0220108 A1 * 8/2013 Oriet ..... F41H 5/007 89/36.08
2013/0263727 A1 * 10/2013 O'Masta ..... F41H 5/023 89/36.02

FOREIGN PATENT DOCUMENTS

WO WO 01/90438 11/2001
WO WO 01/92001 12/2001
WO WO 02/06747 1/2002
WO WO 02/15300 2/2002
WO WO-0239048 A2 * 5/2002 ..... F41H 5/007
WO WO 02/087787 11/2002
WO WO 02/098644 12/2002
WO WO 03/018853 3/2003
WO WO 03/028428 4/2003
WO WO 03/091473 11/2003
WO WO 03/101721 12/2003
WO WO 03/101722 12/2003
WO WO 2004/011245 2/2004
WO WO 2004/011688 2/2004
WO WO 2004/022868 3/2004
WO WO 2004/022869 3/2004
WO WO 2004/043691 5/2004
WO WO 2004/048632 6/2004
WO WO 2005/014216 2/2005
WO WO 2005/047202 5/2005
WO WO 2005/089107 9/2005
WO WO 2007/005832 1/2007
WO WO 2007/139814 12/2007
WO WO 2008/127301 10/2008
WO WO 2008/131105 10/2008
WO WO 2009/023744 2/2009
WO WO 2009/048676 4/2009
WO WO 2009/061539 5/2009
WO WO 2009/105651 8/2009
WO WO 2010/082970 7/2010
WO WO 2010/099218 9/2010
WO WO 2011/139307 11/2011
WO WO 2011/140481 11/2011
WO WO 2011/142841 11/2011
WO WO 2012/003026 1/2012
WO WO 2014/169222 10/2014
WO WO 2015/073094 5/2015
WO WO 2015/073098 5/2015
WO WO 2015/160798 10/2015
WO WO 2015/160822 10/2015

* cited by examiner

IMPULSE MITIGATION SYSTEMS FOR MEDIA IMPACTS AND RELATED METHODS THEREOF

The present application is a national stage filing of International Application No. PCT/US2015/048684, filed Sep. 4, 2015, which claims benefit of priority under 35 U.S.C. § 119(e) from U.S. Provisional Application Ser. No. 62/045,736, filed Sep. 4, 2014, entitled "Sliding Impulse Mitigation Systems for Granular Media Impacts and Related Methods thereof;" the disclosures of which are hereby incorporated by reference herein in their entirety.

STATEMENT OF GOVERNMENT INTEREST

This invention was made with government support under Grant No. W91CRB-11-1-0005 awarded by the DARPA. The government has certain rights in the invention.

FIELD OF THE INVENTION

The present invention relates generally to the field of blast mitigation. More specifically, the invention relates to the subfields of cellular materials implemented as blast mitigation systems for vehicles, crafts or other transportation structures, as well as non-transportation structures.

BACKGROUND

The detonation of a buried explosive creates a high velocity plume of soil that moves perpendicular to the soil surface. The plume can consist of sand or other granular soil media and may be dry or wet. The explosively accelerated soil has a high momentum. The soil plume can transfer a substantial fraction of its momentum to a structure placed near the explosion (such as a vehicle underbelly) in a direction that intercepts the soil plume. The impact of the sand against the structure (e.g., vehicle underbelly) may deform and sometimes fractures the structure.

OVERVIEW

The detonation of a buried explosive creates a high velocity plume of soil that moves perpendicular to the soil surface. The plume can consist of sand or other granular soil media and may be dry or wet. The explosively accelerated soil has a high momentum determined by its velocity and mass product. The momentum is a vector quantity with directionality identical to that of the soil velocity. The soil plume can transfer a substantial fraction of its momentum to a structure placed near the explosion (such as a vehicle or craft underbelly, which may include for example the chassis, body, vehicle components or any combination) in a direction that intercepts the soil plume. This will cause the structure to suffer a sometimes very large acceleration. The impact of the sand against the structure also creates a local stagnation pressure which deforms and sometimes fractures the structure. The present inventors recognize that the momentum transfer and stagnation pressure can be decreased by increasing the distance of soil plume propagation due to spreading of the soil and a reduction in its velocity due to air drag. The present inventors point out that the momentum transferred and pressure applied to the structure can also be reduced by inclining the impacted surface of the structure as shown in the screenshot of FIG. 1. The present inventors point out that in this case the soil slides along the inclined surface and is never fully arrested. The momentum retained by the soil is therefore never transferred to the V-hull and it suffers a smaller acceleration and stagnation pressure.

An aspect of an embodiment of the present invention provides, but not limited thereto, an impulse mitigation system configured to mitigate blast impulse directed to a surface (or structure or target). The system may comprise: a substrate in communication with the surface (or structure or target), wherein the substrate configured to receive an impulse directed to the surface (or structure or target) and to relocate from the surface (or structure or target) in response to received impulse. It should be appreciated that a plurality of substrates may be implemented or utilized.

An aspect of an embodiment of the present invention provides, but not limited thereto, a method of making an impulse mitigation system configured to mitigate blast impulse directed to a surface (or structure or target). The method may comprise: providing a substrate in communication with the surface (or structure or target); configuring said substrate for receiving an impulse directed to the surface (or structure or target); and configuring said substrate to relocate from the surface (or structure or target) upon receipt of the directed impulse.

It should be appreciated that the hull (or the like) and its associated components may be any structure, shape, size, material, or contour as desired or required.

It should be appreciated that a mobile robot may be a transportation vehicle, transportation device, or transportation craft, for example.

It should be appreciated that a stationary mobile robot may be a type of non-transportation structure, system, or device, for example.

It should be appreciated that a chassis may of course be base frame of a motor vehicle or other transportation device or craft, for example. Also, a chassis may be a frame or a structural network of equipment, architecture, or housing, etc.

These and other objects, along with advantages and features of various aspects of embodiments of the invention disclosed herein, will be made more apparent from the description, drawings and claims that follow.

BRIEF DESCRIPTION OF THE DRAWINGS

The accompanying drawings, which are incorporated into and form a part of the instant specification, illustrate several aspects and embodiments of the present invention and, together with the description herein, serve to explain the principles of the invention. The drawings are provided only for the purpose of illustrating select embodiments of the invention and are not to be construed as limiting the invention.

DETAILED DESCRIPTION OF EXEMPLARY EMBODIMENTS OF THE PRESENT INVENTION

Figure 1:
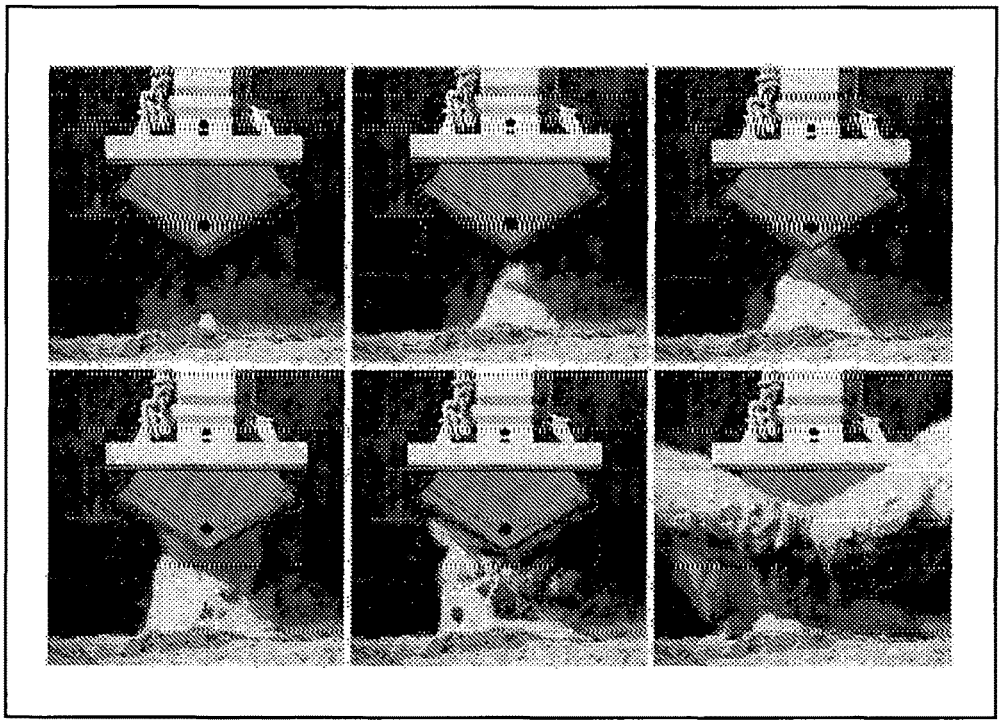
FIG. 1 is a screenshot of a time lapse photographs of the soil ejected by a landmine interacting with a V-hull structure. The soil plume propagates normal to the soil surface and slides along the inclined surface of the V-hull.
Figure 2:
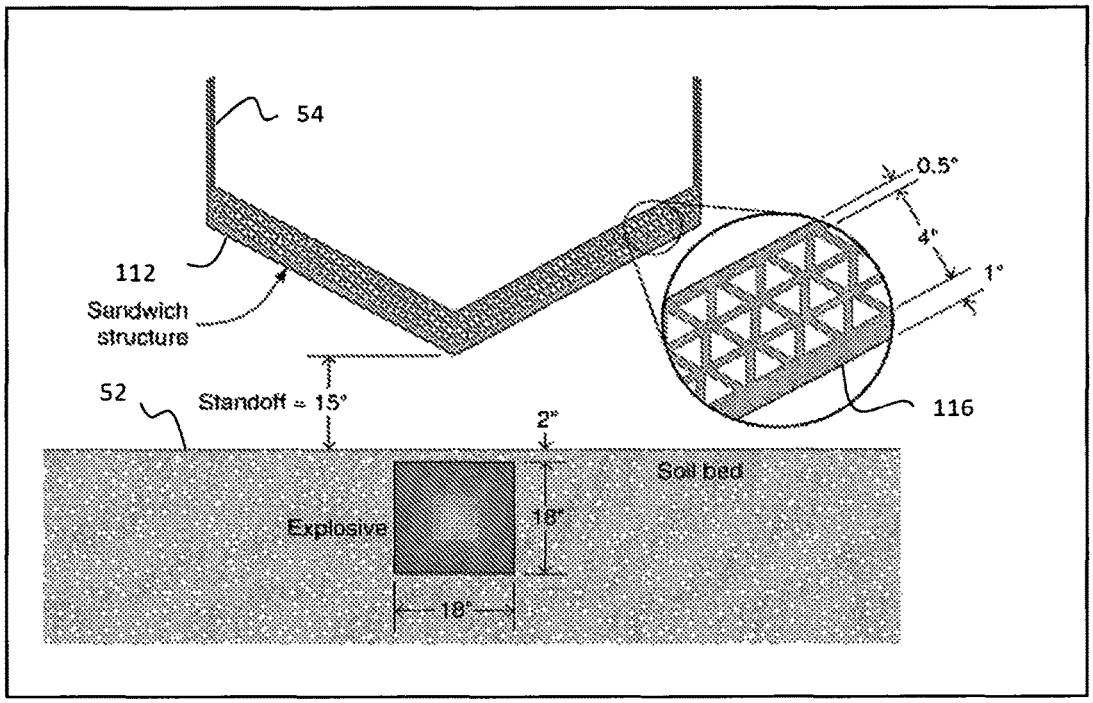
FIG. 2 is a screen shot of an example of a mine blast impulse mitigation concept. A V-hull sandwich panel is used to deflect the soil ejected upwards by the detonation of a large landmine. The rigid sandwich panel reduces the deflection of the interior surface of the hull.

Referring to an example, a mine protected vehicles may use its hull 54, such as a V-shaped to provide a V-hull to reduce their vulnerability to land mines (See FIG. 2). The favorable V-angle results from a trade-off between reducing the momentum transferred (favored by acute included angles such as 90°), the reduced space inside the vehicle (favored by an included angle approaching 180°) and the need to limit the total height of the vehicle (to reduce the risk of roll-over). The high pressure applied by the soil impact with the underside of even an inclined plate surface causes the impacted plate to undergo sever dynamic deflection into the interior of the vehicle. The present inventors submit that this can be substantially reduced by using a of such a sandwich underbelly concept as shown in the screenshot of FIG. 2. The present inventors note that while the sandwich structure 116 is substantially thicker than the solid material plate of identical mass per unit area, the concept shown in FIG. 2 uses unused space within the interior of the general structure 112 to accommodate the extra volume and does not require the impact surface to be moved closer to the soil surface 52 (which would increase the transferred impulse by decreasing the standoff distance).

Figure 3:
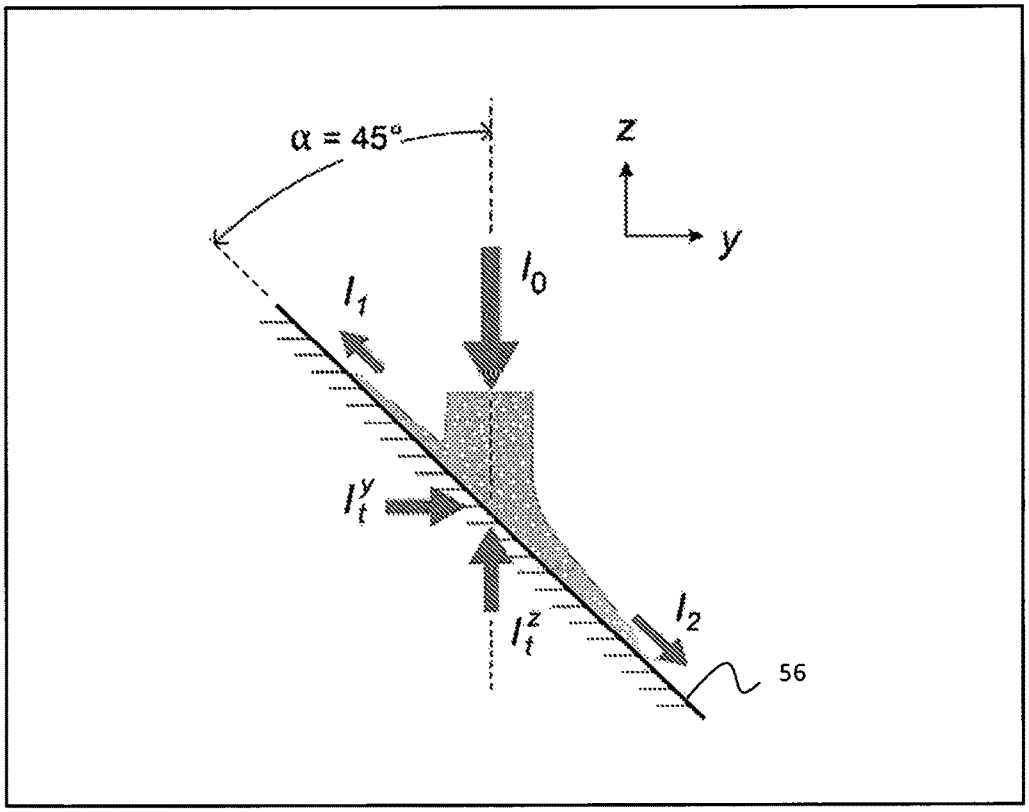
FIG. 3 is a screen shot of the incident momentum, $I_o$ of a column of soil that impacts a rigid surface inclined at 45° to the direction of motion of the soil can be resolved into components $I_1$ and $I_2$ travelling along the surface of the rigid body. A reaction (transmitted) momentum is created in the rigid body with components $I_t^y$ and $I_t^z$.

The impact of a soil plume with an inclined rigid surface 56 can be analyzed with the help of the figure shown in the screenshot of FIG. 3. In this case a collimated plume of soil (or other granular or even fluid medium) impacts the surface of a rigid structure inclined at $\alpha$=45° to the plume propagation direction (as occurs for a V-hull with interior angle of 90°). The incident soil or fluid plume has a mass, $m_s$ and velocity, $v_s$ and their product, $m_s v_s$ defines an incident momentum (impulse) denoted by $I_o$. Upon impact with the surface, most of the soil is partially redirected and flows down the inclined surface with a momentum $I_2$. However, the momentarily stagnated soil at the impact site can also cause some soil to the deflected up the rigid surface and this carries a momentum $I_1$. If a simple Cartesian coordinate system is used to analyze the components of momentum, it can be shown that the soil impact induces a reaction momentum in the inclined surface which transfers momentum to the structure. The components of this (vector) momentum are denoted $I_t^z$ and $I_t^y$ in FIG. 3. Note that as the angle $\alpha$ is increased to 90°, $I_1$ approached $I_2$.

Figure 4:
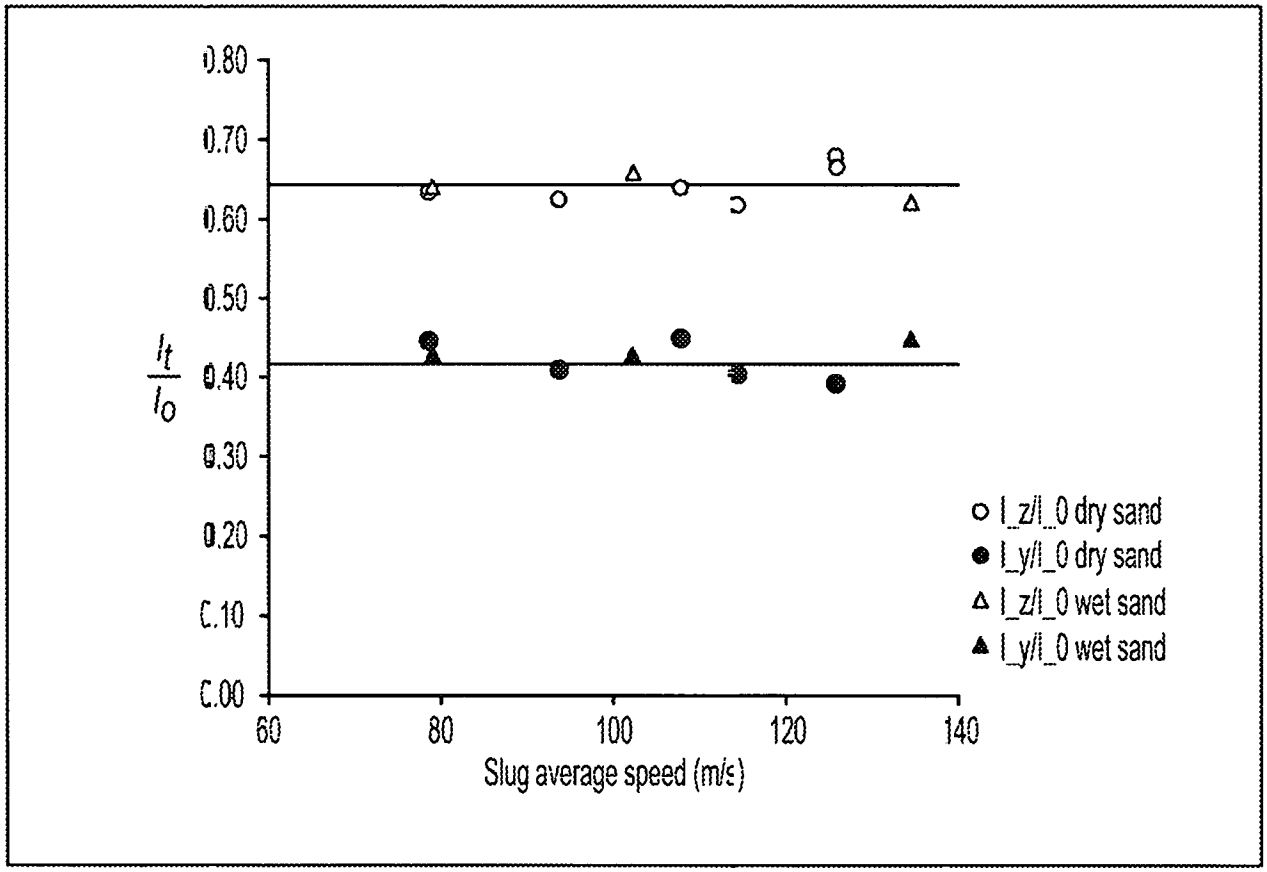
FIG. 4 is a screenshot pertaining to the experimentally measured transmitted impulse to a rigid plate inclined at 45° to a sand slug as a function of the sand slug velocity for slugs of fixed mass; whereby the Figure illustrates the results for both y and z-components of the momentum resulting from impacts by dry and water saturated sand.

The present inventors submit that it is possible to arrange an experiment to further explore the momentum transfer process as a granular medium impacts an inclined surface. Using a gas gun, it is possible to launch a cylindrical column of granular particles towards an inclined rigid surface with an inclination angle $\alpha$=45°. The momentum transferred to the structure can then be measured with accelerometers. FIG. 4 is a screenshot that graphically shows the results of such an experiment where dry and water saturated sand cylinders impacted the inclined plate at various velocities. In this case the z-component of the transferred momentum was larger than the y-component and was unaffected by the moisture content of the granular medium. The splitting of the momentum into these two components was also independent of the sand impact velocity.

Figure 5:
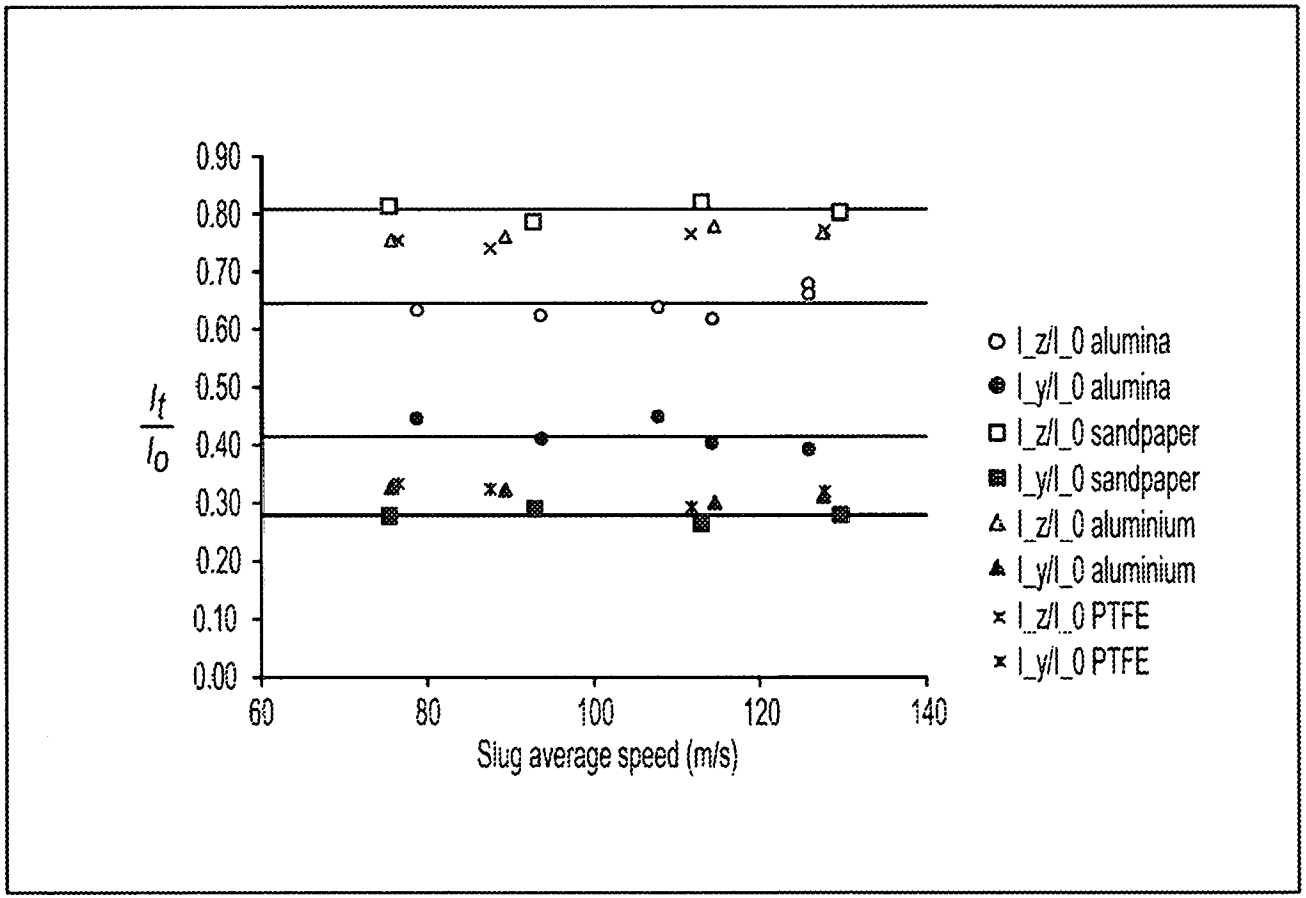
FIG. 5 is a screen shot graphically illustrating that impacting the surface of an inclined plate made from hard materials (from PTFE, aluminum to alumina) it is possible to reduce the friction between sand particles and the plate and thereby reduce the transferred impulse; and increasing the friction paper by covering the impact face with coarse sandpaper increases the impulse that is transferred.

The present inventors have discovered that the momentum transfer process is highly sensitive to the friction coefficient of the impacted surface. Figure S is a screenshot that graphically shows the results of an experiment where the impacted surface friction coefficient was changed. Surfaces that are easily eroded by the soil particle impact such as soft Polytetrafluoroethylene (PTFE) and aluminum have very high friction coefficients. Surfaces such as coarse sandpaper severely impede the flow of sand particles across the surface and also have very high friction coefficients. On the other hand, very hard (nondeformable) surfaces such as that of alumina have low friction coefficients for sand particle impacts with velocities in the 100-200 m/s range. It can be seen in the graph of the screenshot of FIG. 5 that alumina has a much lower z-component of transferred momentum than the other surfaces and it can be concluded that increasing the friction coefficient increases the z-component of transferred momentum. Essentially, a low friction coefficient surface allows the soil particles to slide over the inclined surface with very little resistance. As a result, the sand retains more of its original momentum and so less is transferred to a structure. However, the practical implementation of this concept could be problematic because the soil particles from a real landmine can travel at very velocity exceeding 2000 m/s in some cases. The impact of such a particle can create surface pressures of order $\rho v_p^2$ which for particles with a density $\rho$=3,000 kg/m$^3$ and $v_p$=2,000=3×$10^3\cdot(2\times10^3)^2$)=12 GPa which approaches the hardness of ceramics. It might therefore require the use of very hard, very smooth and therefore expensive surfaces. Since these surfaces are likely to be impacted frequently during normal use, they would need to also be very durable and therefore need a high fracture toughness. One candidate would be a cermet or metal bonded ceramic material with an appropriate surface treatment.

Figure 6:
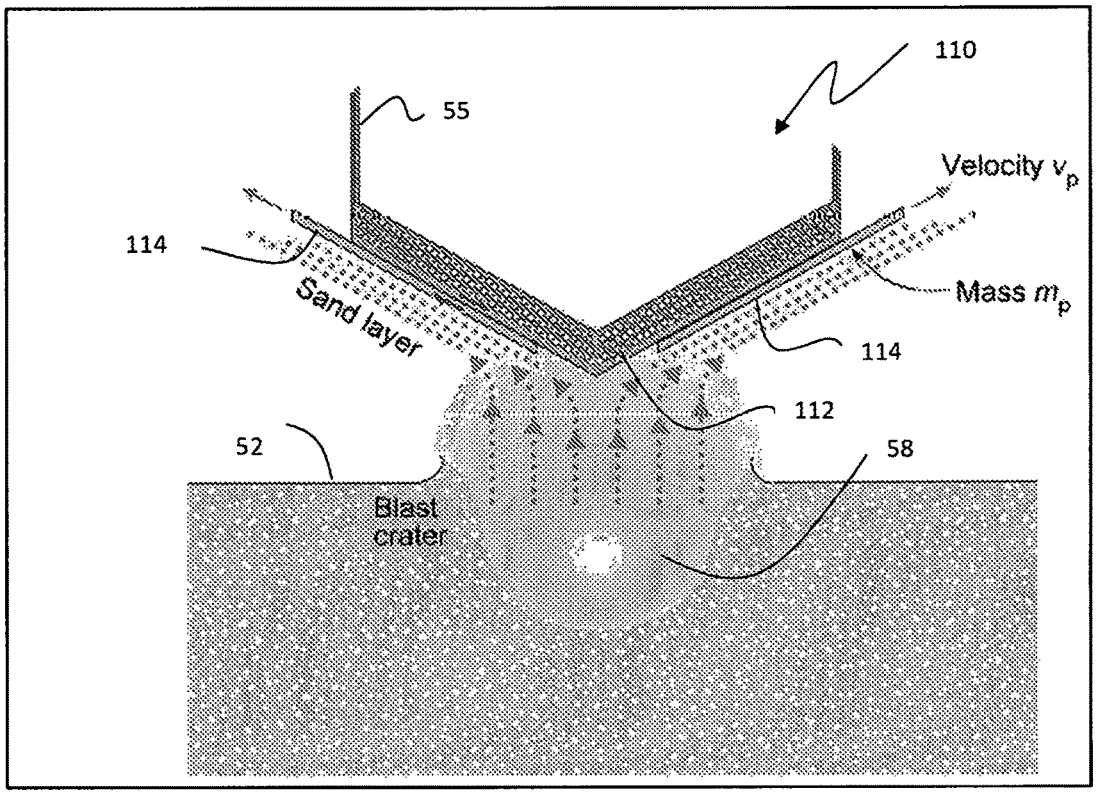
FIG. 6 is a screenshot showing the impulse transferred to a V-hull can be reduced by weakly attaching a plate of mass mp to the inclined surface of the hull. A shear thinning fluid can be used to reduce the dynamic friction between the hull and the sliding plate. Impact of the plate by soil impact accelerates the plate to a velocity Vp and it acquires a momentum which reduces that transferred to the vehicle hull.

The present inventors submit that in order to reduce impulse transfer to the inclined surface it is necessary to maximize the fraction of impulse carried away from the surface. As the intensity of the soil impact increases it will be difficult to maintain the low friction coefficient needed for this. In this case the present inventors claim that it is possible to reduce the impulse transfer by weakly attaching a plate (or other structure type as desired or required) to the inclined surface using easily sheared pins or other similar approach. The exterior surface of the attached plate (or other structure type) has a friction coefficient which causes it to acquire momentum in the direction of sand flow on the inclined surface. If it has a weak shear strength interface with the rigid inclined surface (such as achieved with a shear thinning fluid) then the attached plate would acquire a momentum characteristic of a surface with a very low friction coefficient. FIG. 6, for example, is a screenshot that shows an embodiment of the sliding plate mitigation concept, which represents an approach for an impulse mitigation system 110. The impulse transferred to a V-hull 55 of the structure 112 from a blast 58 originating the sand 52 can be reduced by weakly attaching a substrate 114 (such as plate as shown, or other structure or cellular material as desired or required) of mass $m_p$ to the inclined surface of the hull. A shear thinning fluid can be used to reduce the dynamic friction between the hull 55 and the sliding plate (i.e., substrate 114). Impact of the plate by soil impact accelerates the plate to a velocity Vp and it acquires a momentum which reduces that transferred to the vehicle hull.

Figure 7:
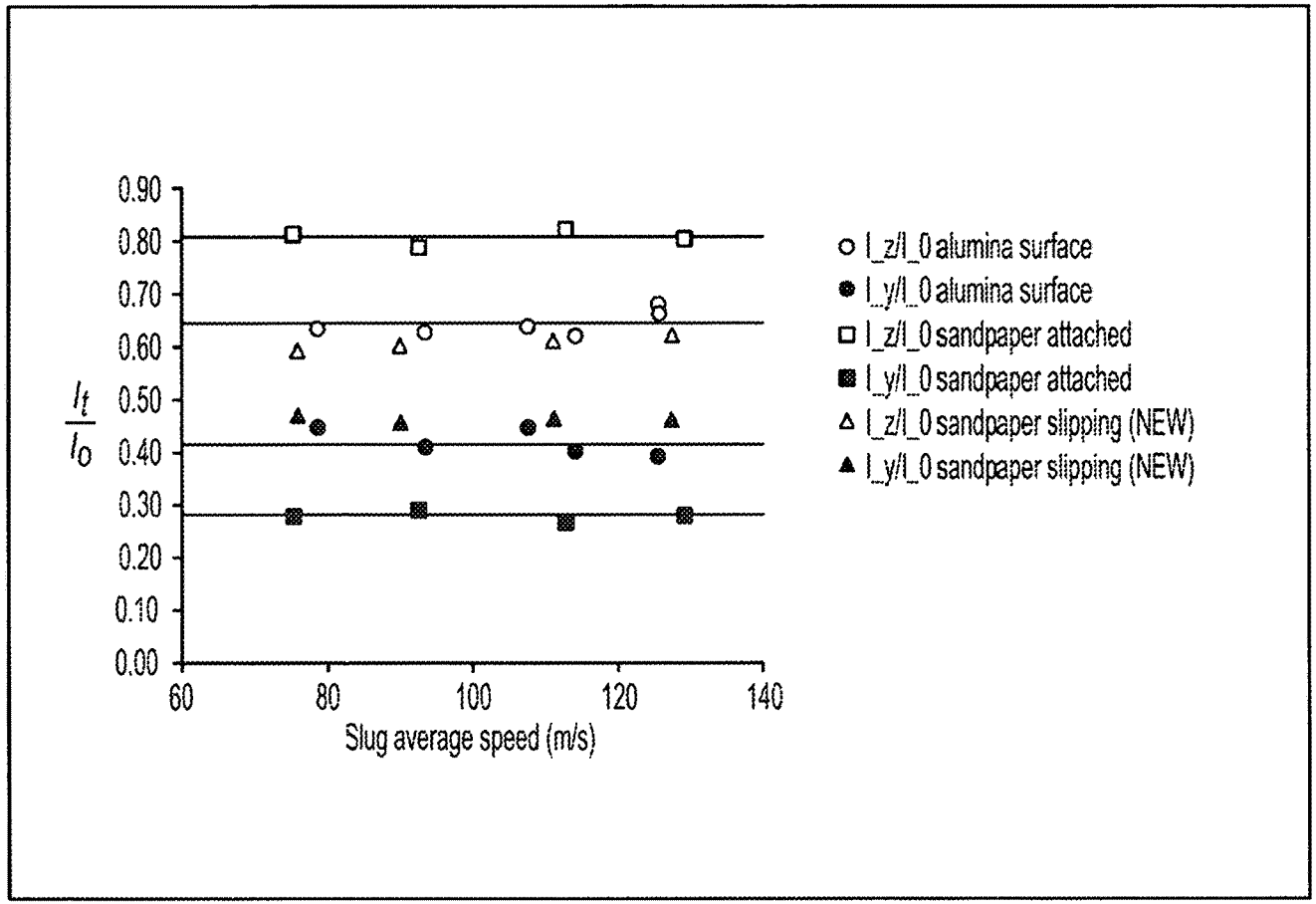
FIG. 7 is a screenshot graphically illustrating a comparison of the impulse components transferred to an inclined rigid surface for surfaces with various friction coefficients and a surface with a sliding layer of sandpaper attached to the rigid surface by a shear thinning fluid; whereby it may be noted the reduced z-component of the transferred momentum when the sandpaper was allowed to slide.
Figure 8:
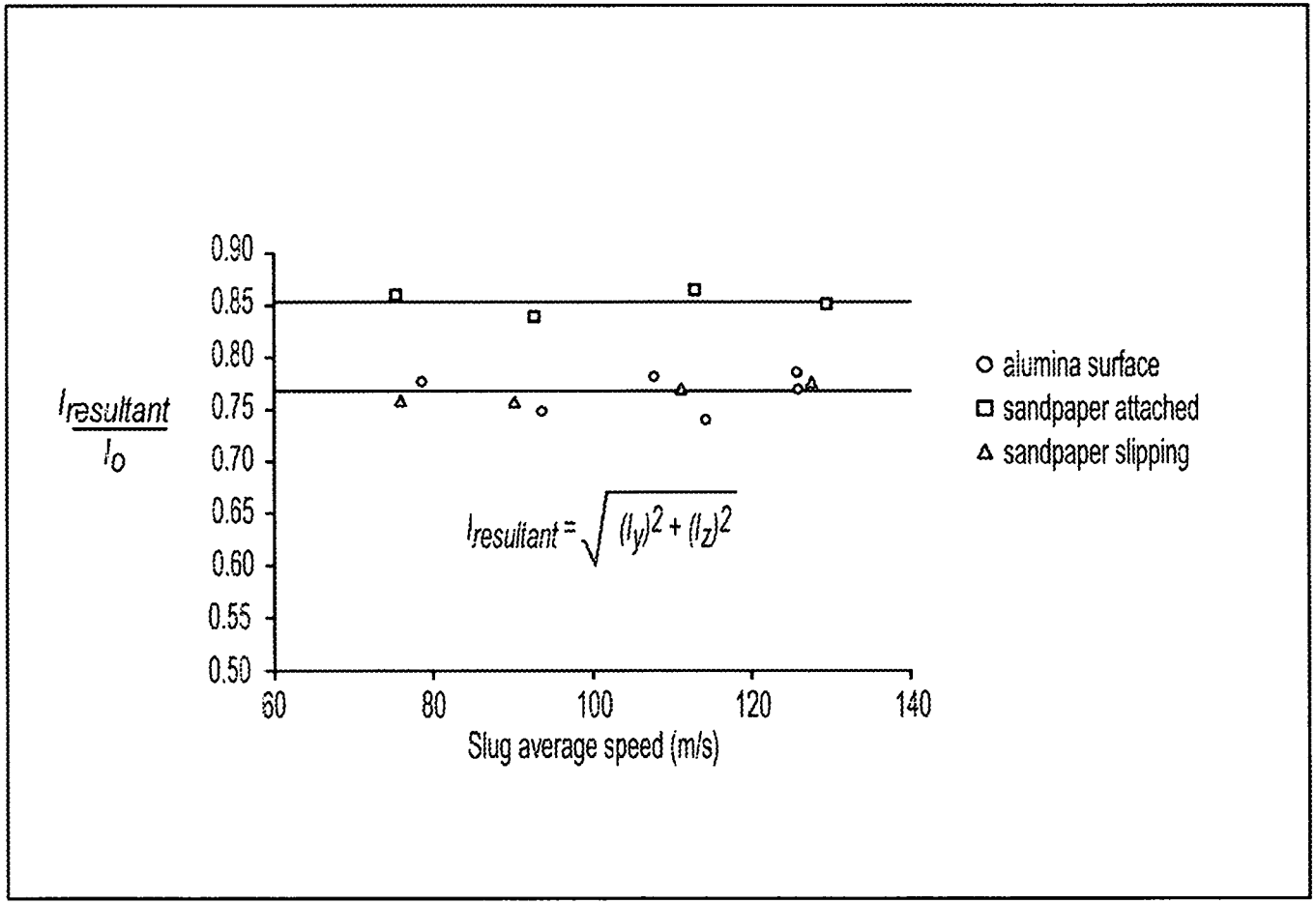
FIG. 8 is a screen shot that graphically illustrates the resultant momentum $(I_z^2+I_y^2)^{1/2}$ normalized by the incident momentum $I_o$ is plotted against soil slug speed for the low friction coefficient surface (alumina), the high friction coefficient surface and a slipping surface showing that the resultant impulse approaches the frictionless limit.

To test this concept, the present inventors have attached a sheet of sand paper using a shear thinning gel to the rigid inclined surface studied above and impacted it with sand slugs of various velocities. FIG. 7 is a screenshot that graphically shows the results for this case (sandpaper slipping NEW) and compares them to those obtained with other surfaces of various friction coefficients. It is evident that the effective coefficient of friction is controlled by that of the shear thinning fluid and not the impacted surface which has a very high coefficient of friction. FIG. 8 is a screenshot that graphically shows that the resultant momentum transferred to the structure is the same as that transferred by a surface with very low friction coefficient (alumina).

The present inventors note that the momentum carried by the slipping plate as it escapes the V-surface is unavailable to be transferred to the structure, and thereby provides a potent means of reduction of impulse transferred to the structure. The present inventors also note that the plate could be made of a frangible material which breaks apart shortly after initial acceleration thereby reducing the risk of collateral damage from the plate. The present inventors also note that a propellant could be used to resist the motion of the slipping plate or to even pre-accelerate it towards incoming soil to achieve impulse cancellation. For example, this would require the use of a sensor to detect electromagnetic emissions from the detonation at the instant of explosive detonation or to detect sudden ground motion (e.g. using a ground surface penetrating radar sensor) as the explosion generated shock wave reaches the soil surface.

Figure 9:
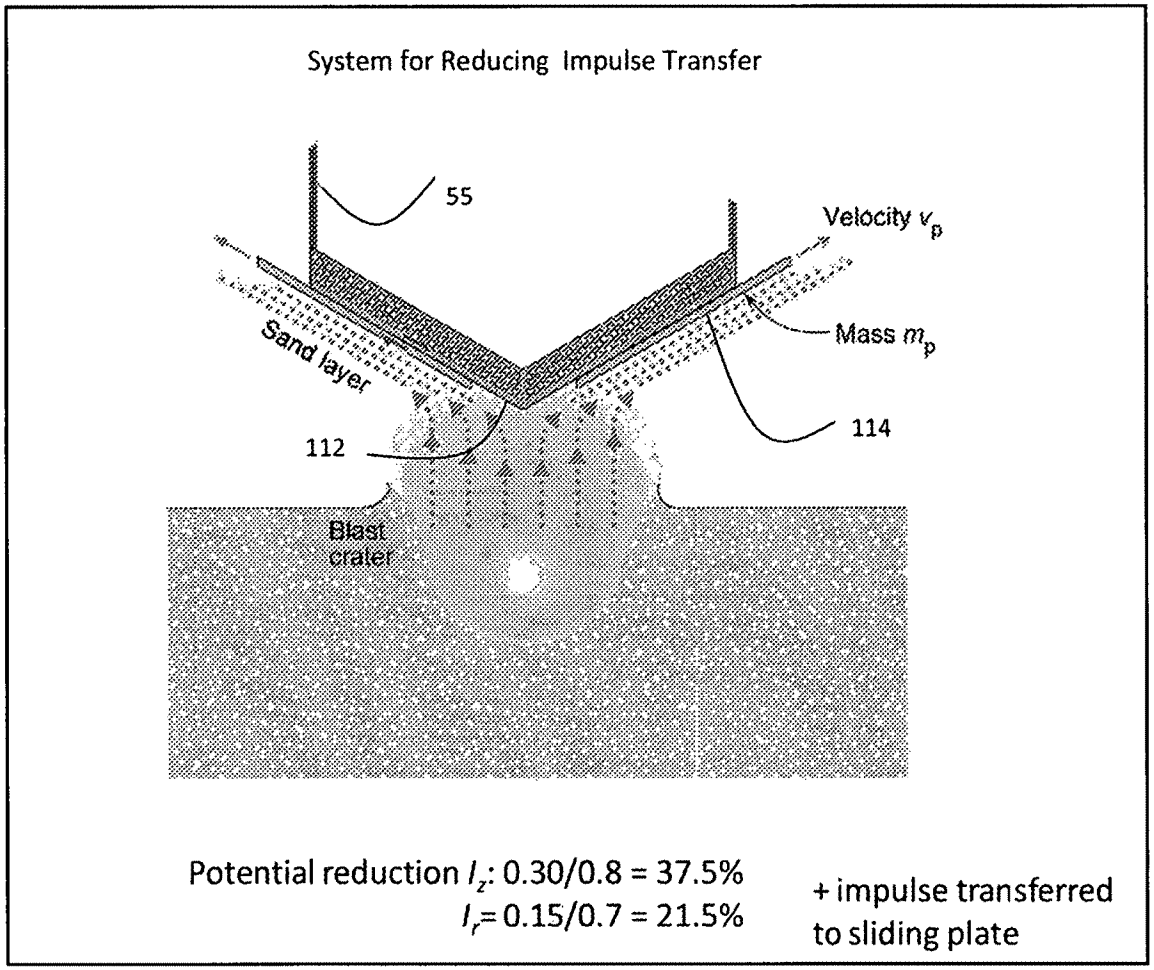
FIG. 9 is a screen shot showing a novel system for reducing impulse to a V-hull whereby impulse is transferred to sliding plates.

FIG. 9 is a screenshot that shows an embodiment of the sliding plate mitigation concept as similarly shown in FIG. 6 (which represents an approach for an impulse mitigation system 110). The impulse transferred to a V-hull 55 from a blast 58 can be reduced by weakly attaching a substrate 114 (such as plate as shown) of mass mp to the inclined surface of the hull. A shear thinning fluid can be used to reduce the dynamic friction between the hull 55 and the sliding plate. Impact of the plate by soil impact accelerates the plate to a velocity Vp and it acquires a momentum which reduces that transferred to the vehicle hull. For this screenshot, a novel system for reducing impulse transfer to a V-hull is shown. For example, but not limited thereto, provided is a potential reduction $I_z$: 0.30/0.8=37.5%, $I_r$=0.15/0.7=21.5%; and whereby impulse is transferred to sliding plates.

Figure 10:
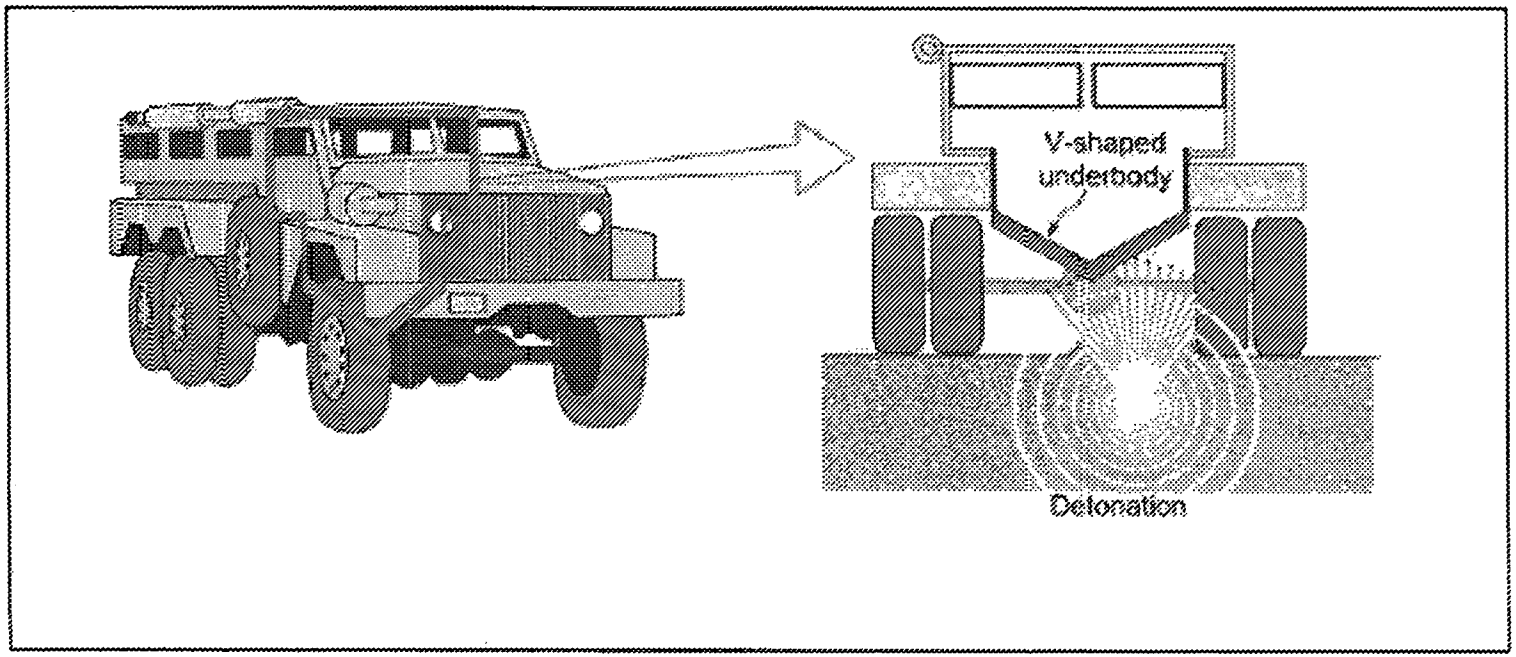
FIG. 10 is a screenshot of a vehicle with V-shaped underbody designed to protect against the soil ejects generated by the detonation of a shallow-buried explosive.

FIG. 10 is a screenshot of a vehicle with V-shaped underbody designed to protect against the soil ejecta generated by the detonation of a shallow-buried explosive.

Figure 11:
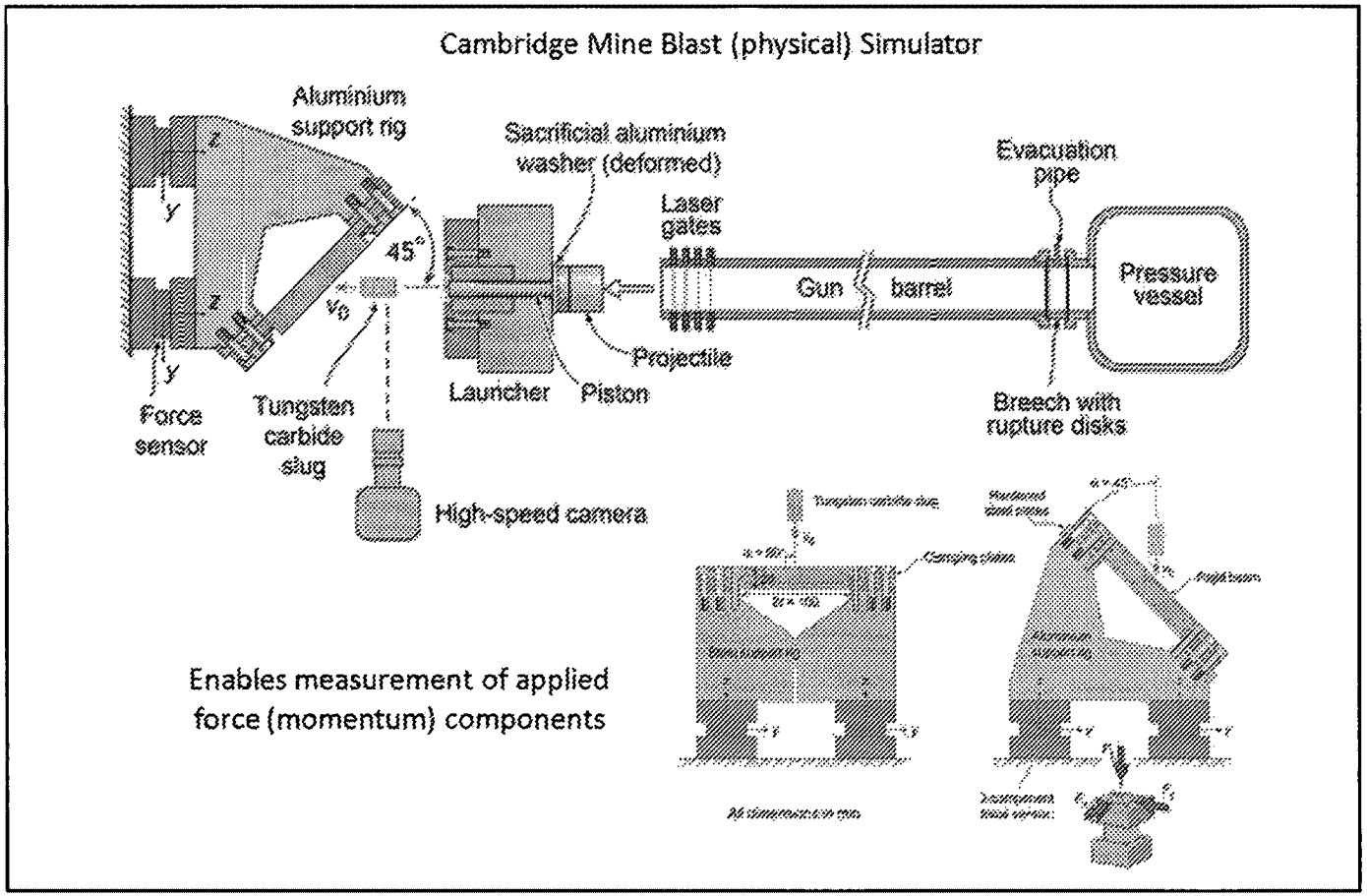
FIG. 11 is a screenshot pertaining to a Cambridge Mine Blast (physical) Simulator.

FIG. 11 is a screenshot pertaining to a Cambridge Mine Blast (physical) Simulator.

Figure 12:
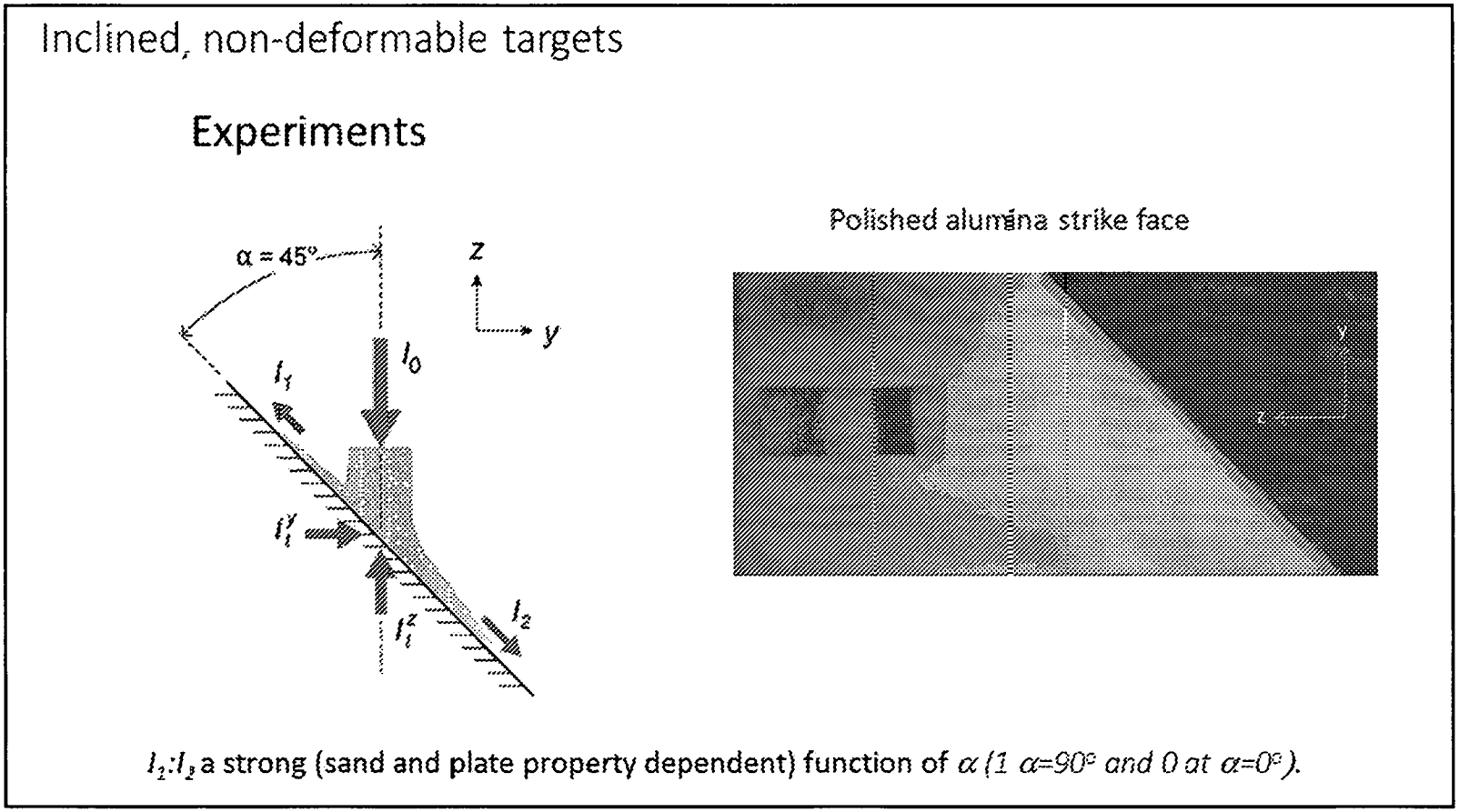
FIG. 12 is a screenshot of a set up pertaining to inclined, non-deformable targets for experiments involving polished alumina strike face.

FIG. 12 is a screenshot of a set up pertaining to inclined, non-deformable targets for experiments involving polished alumina strike face.

Figure 13:
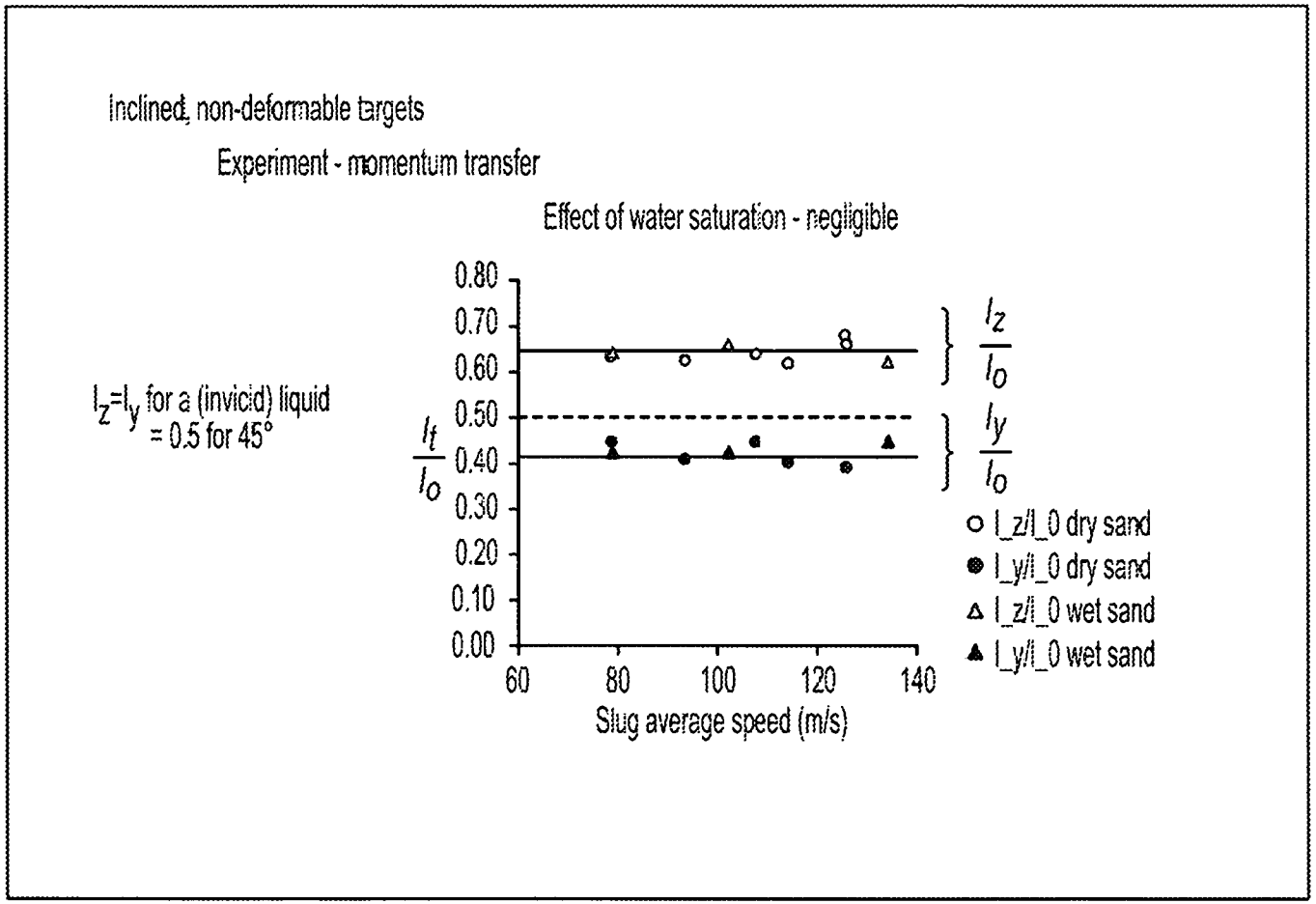
FIG. 13 is a screenshot of a graph pertaining to inclined, non-deformable targets for experiments regarding momentum transfer whereby the effect of water saturation is negligible.

FIG. 13 is a screenshot of a graph pertaining to inclined, non-deformable targets for experiments regarding momentum transfer whereby the effect of water saturation is negligible.

Figure 14:
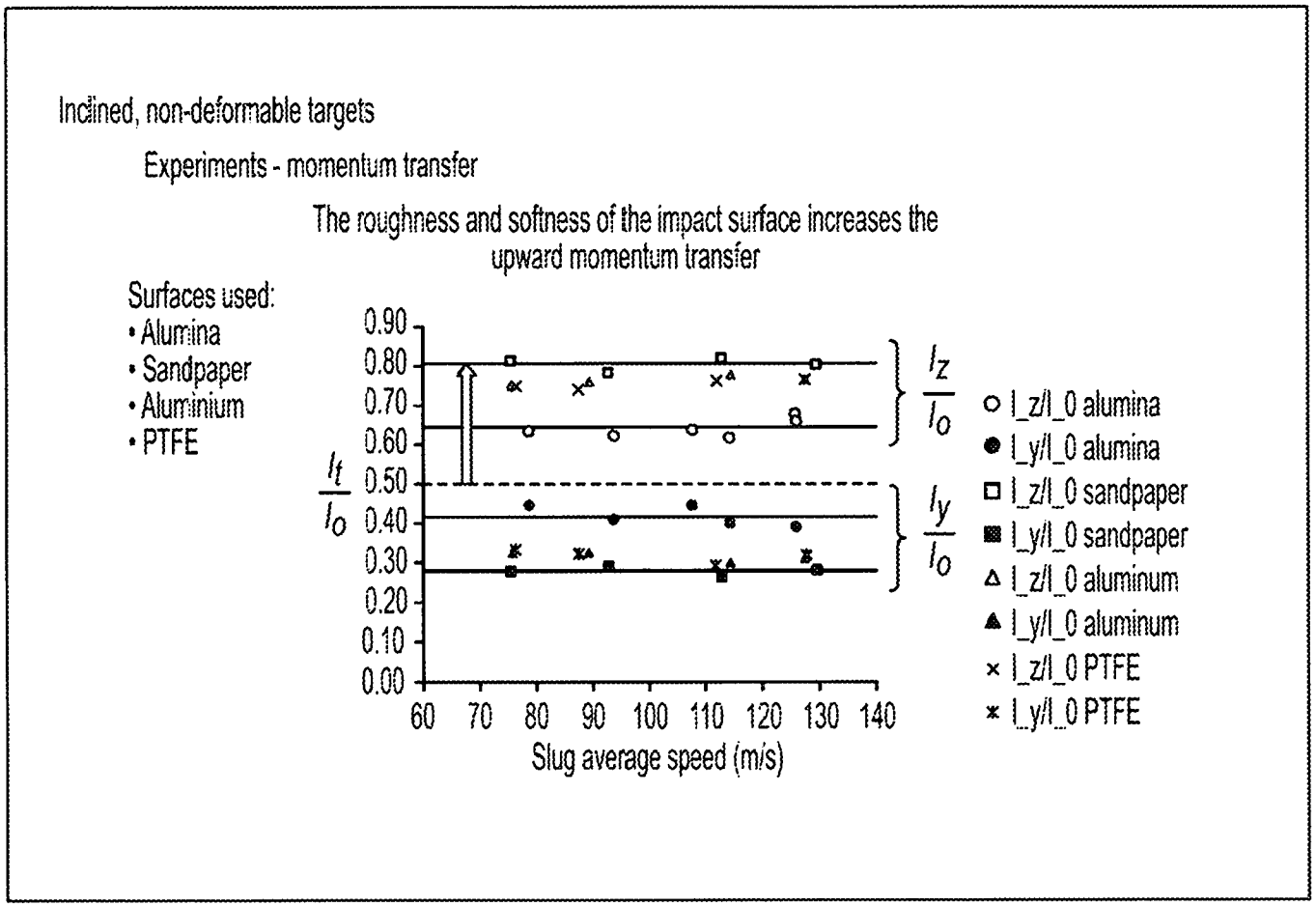
FIG. 14 is a screenshot of a graph pertaining to inclined, non deformable targets for experiments regarding momentum transfer whereby the roughness and softness of the impact surface increases the upward momentum.

FIG. 14 is a screenshot of a graph pertaining to inclined, non deformable targets for experiments regarding momentum transfer whereby the roughness and softness of the impact surface increases the upward momentum.

Figure 15:
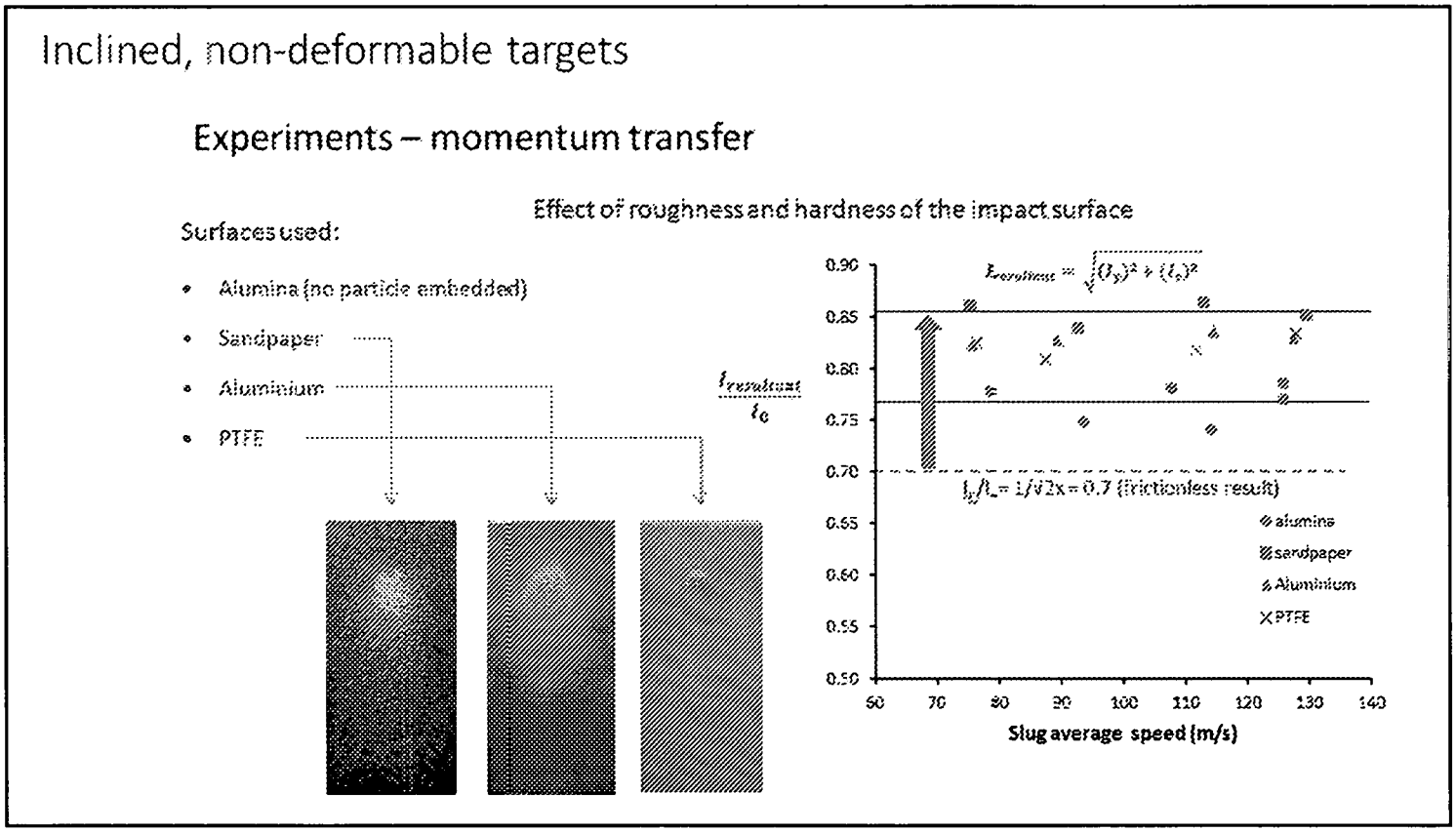
FIG. 15 is a screenshot of micrographic type depictions of various surfaces and a graph pertaining to inclined, non-deformable targets for experiments regarding momentum transfer whereby the effect of roughness and hardness of the impact surface is graphically demonstrated.

FIG. 15 is a screenshot of micrographic type depictions of various surfaces and a graph pertaining to inclined, non-deformable targets for experiments regarding momentum transfer whereby the effect of roughness and hardness of the impact surface is graphically demonstrated.

Figure 16:
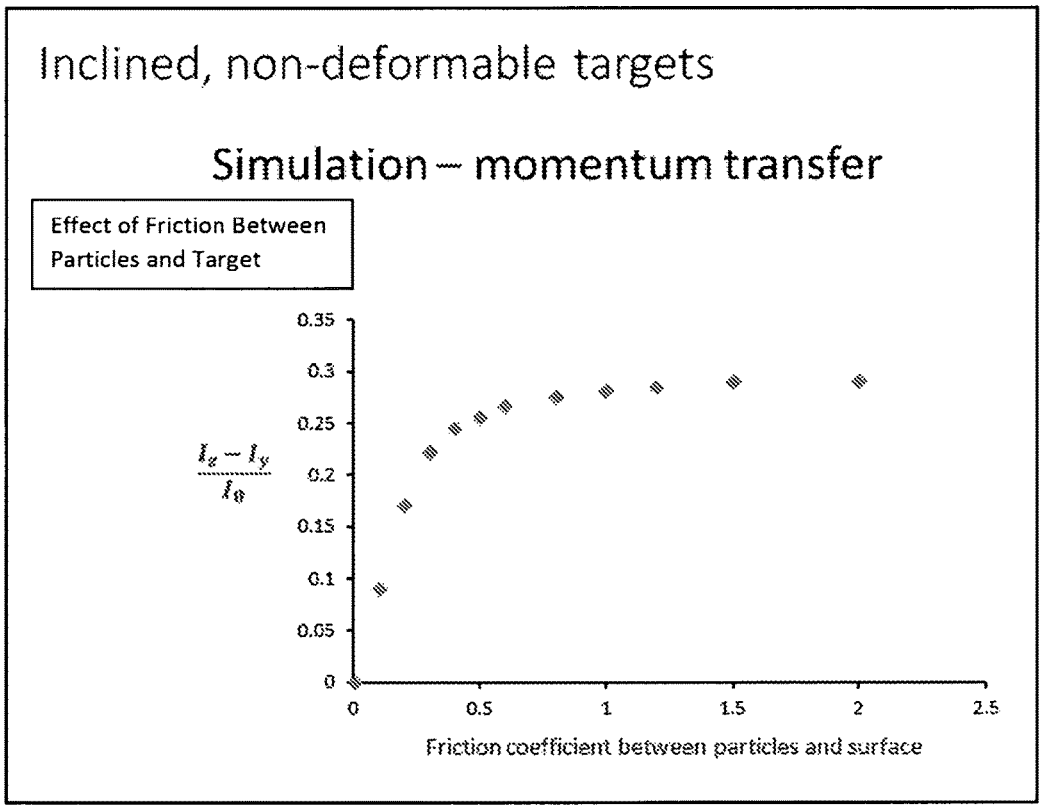
FIG. 16 is a screenshot of a graph pertaining to inclined, non-deformable targets for the simulation of momentum transfer pertaining to the effect of friction between particles and target/surface.

FIG. 16 is a screenshot of a graph pertaining to inclined, non-deformable targets for the simulation of momentum transfer pertaining to the effect of friction between particles and target/surface.

Figure 17:
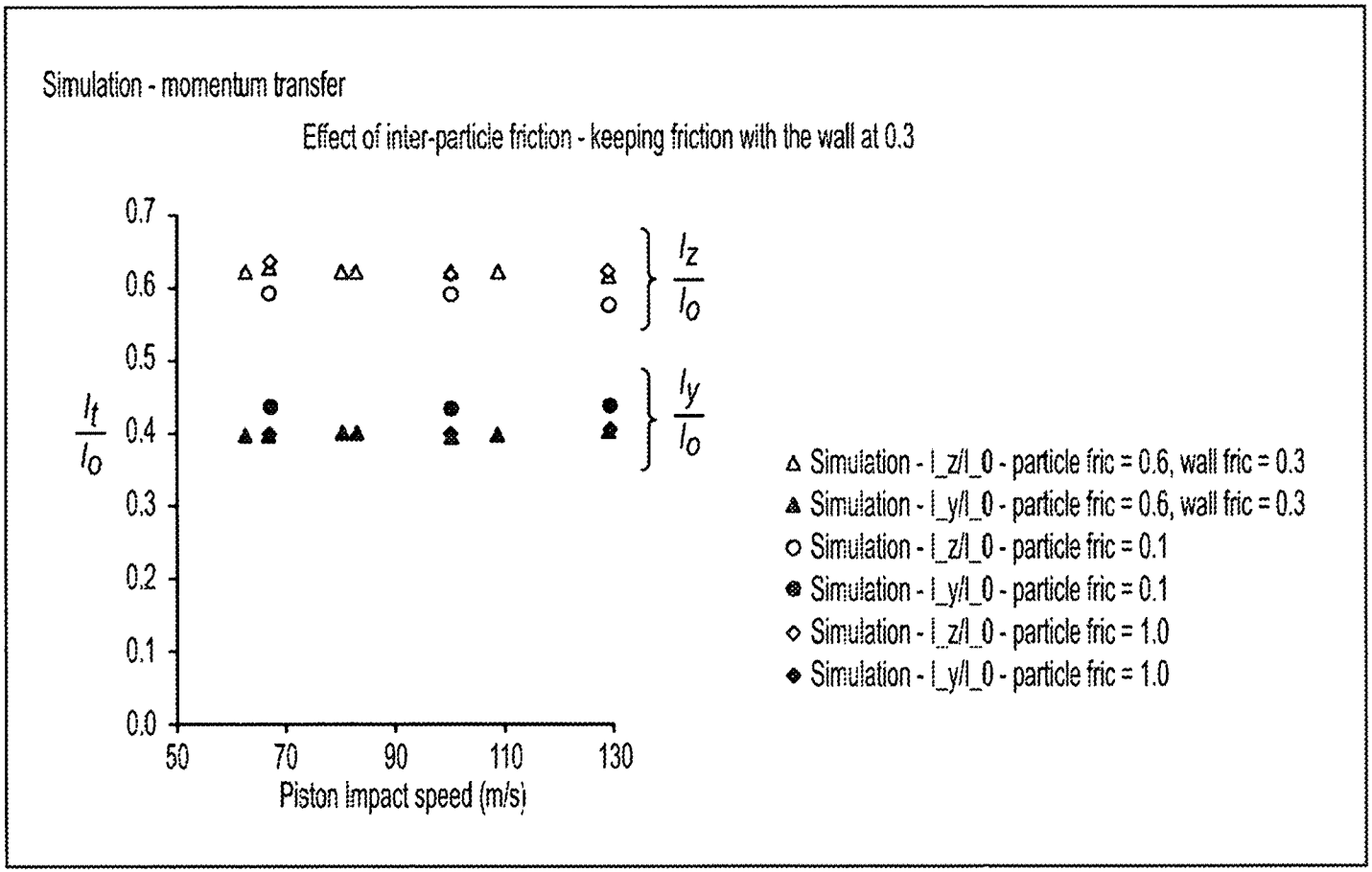
FIG. 17 is a screenshot of a graph pertaining to the simulation of momentum transfer showing the effect of inter-particle friction while keeping friction with the wall friction at 0.3.

FIG. 17 is a screenshot of a graph pertaining to the simulation of momentum transfer showing the effect of inter-particle friction while keeping friction with the wall friction at 0.3.

Figure 18:
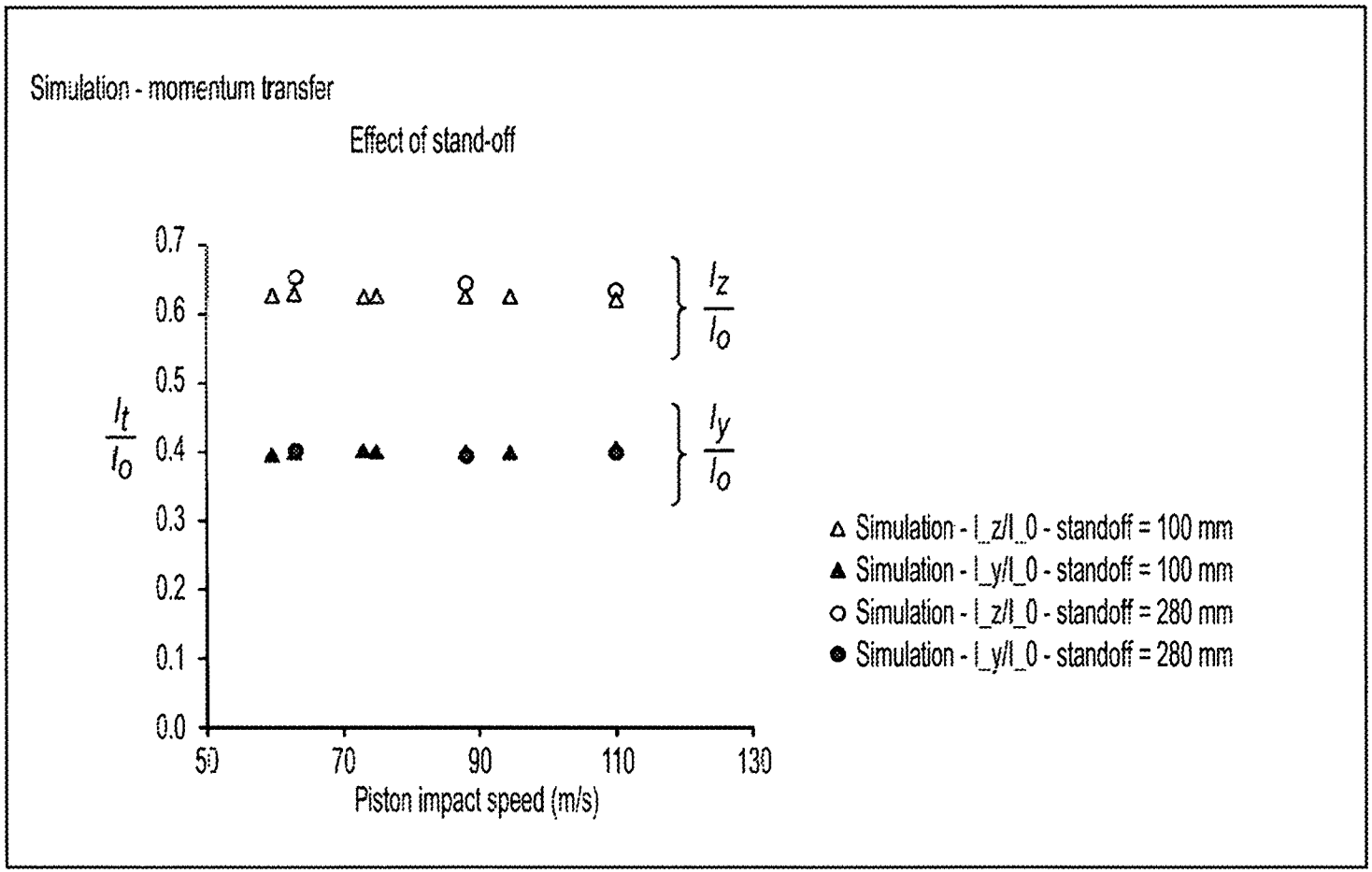
FIG. 18 is a screenshot of a graph pertaining to the simulation of momentum transfer showing the effect of stand-off.

FIG. 18 is a screenshot of a graph pertaining to the simulation of momentum transfer showing the effect of stand-off.

Figure 19:
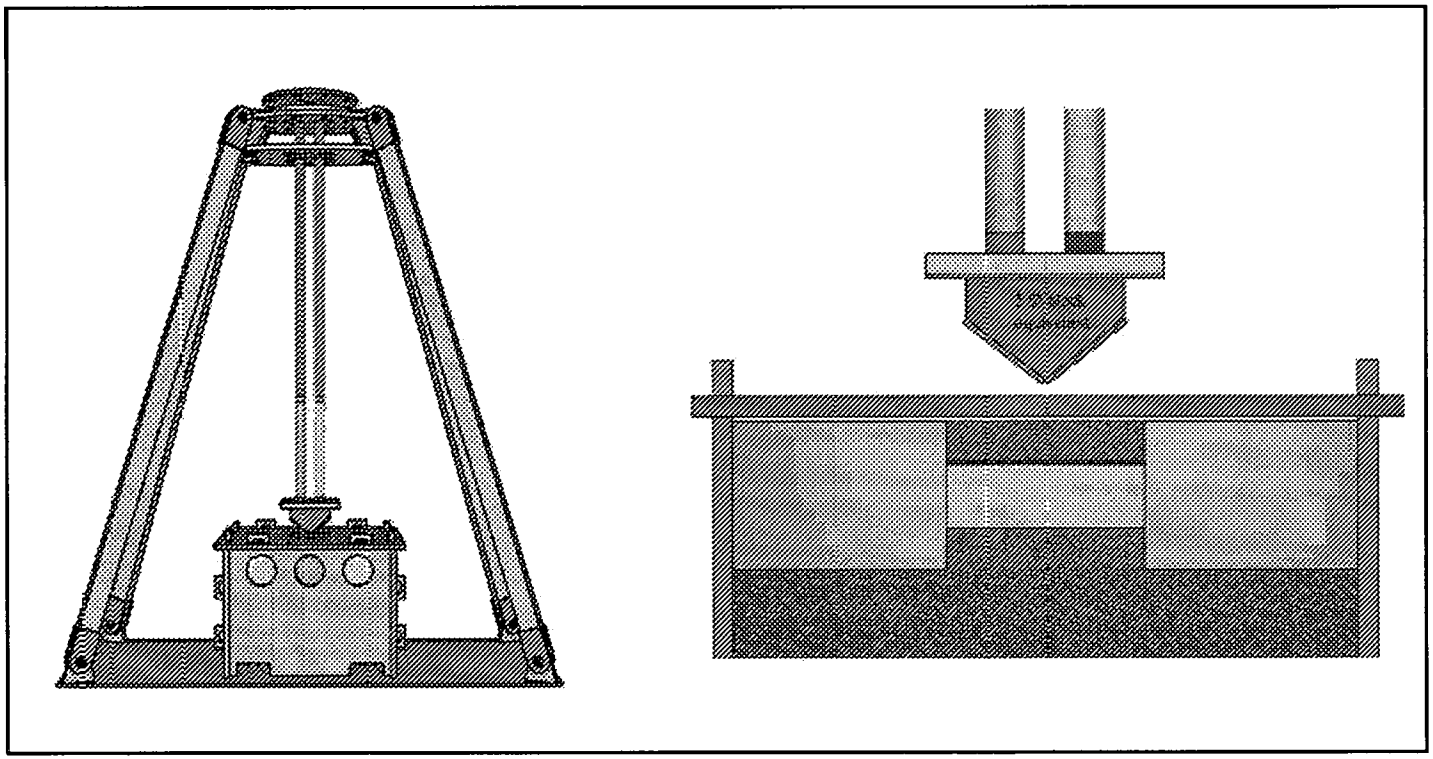
FIG. 19 is a screenshot of an experimental set up for blast simulation system.

FIG. 19 is a screenshot of an experimental set up for blast simulation system.

Figure 20:
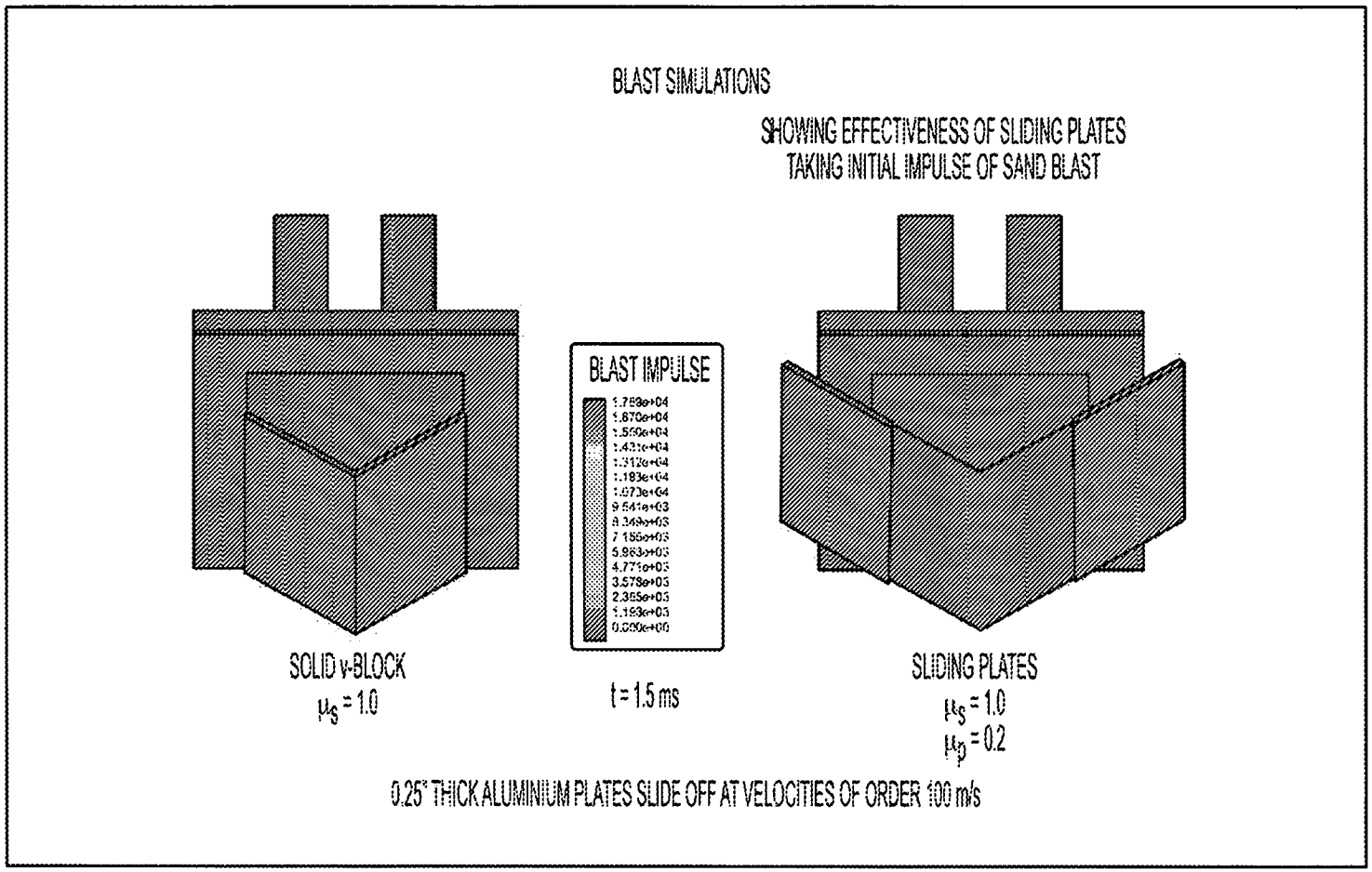
FIG. 20 is a screenshot of blast simulations showing effectiveness of sliding plates taking initial impulse of a sand blast.

FIG. 20 is a screenshot of blast simulations showing effectiveness of sliding plates taking initial impulse of a sand blast.

Figure 21:
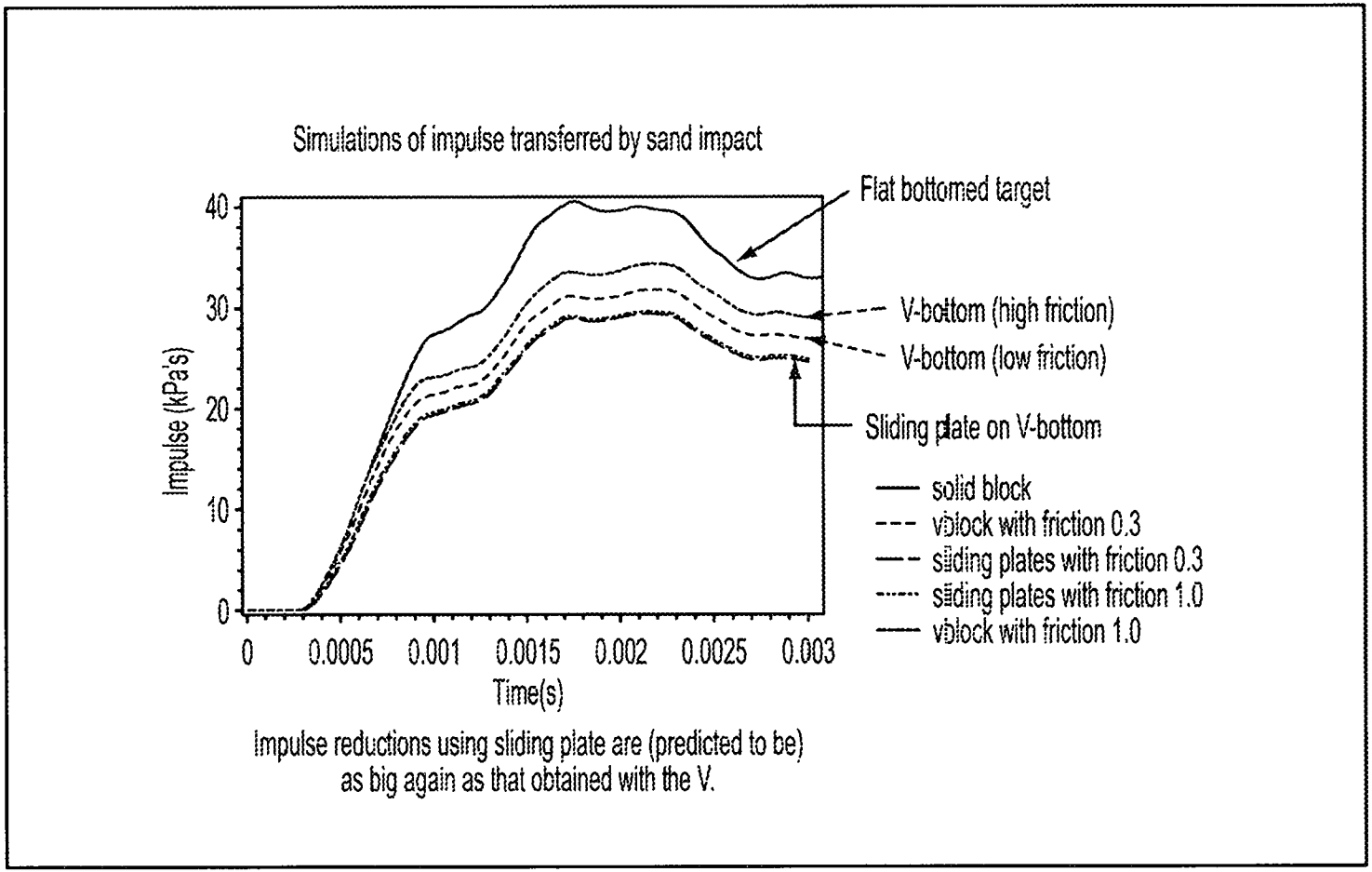
FIG. 21 is a screenshot of a graph pertaining to simulations of impulse transferred by sand impact whereby the impulse reductions using sliding plate are (predicted to be) as big again as that obtained with the V (compared to flat bottomed).

FIG. 21 is a screenshot of a graph pertaining to simulations of impulse transferred by sand impact whereby the impulse reductions using sliding plate are (predicted to be) as big again as that obtained with the V (compared to flat bottomed).

Figure 22:
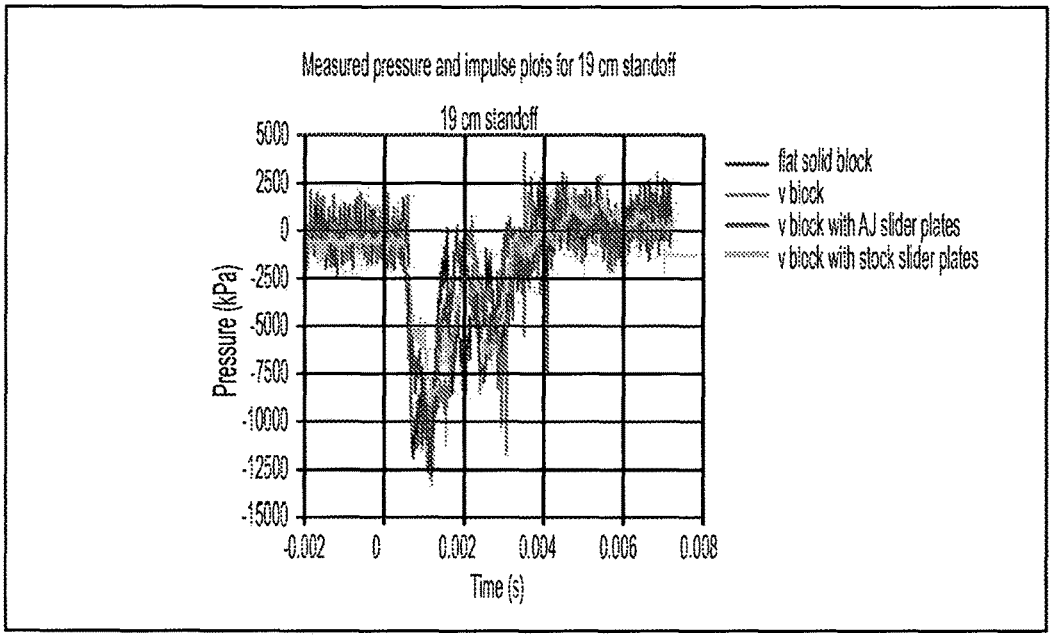
FIG. 22 is a screenshot of a graph illustrating the measured pressure for 19 cm standoff.

FIG. 22 is a screenshot of a graph illustrating the measured pressure for 19 cm standoff pertaining to the experimental setup shown in the screenshots of FIGS. 19 and 20.

Figure 23:
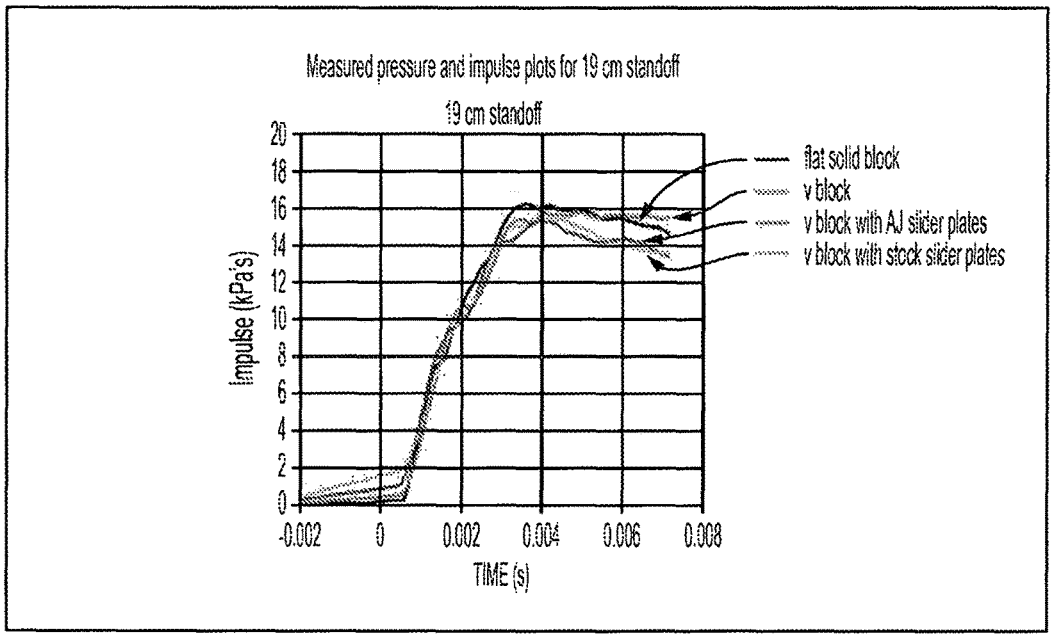
FIG. 23 is a screenshot of a graph illustrating the impulse plots for 19 cm standoff.

FIG. 23 is a screenshot of a graph illustrating the impulse plots for 19 cm standoff pertaining to the experimental setup shown in the screenshots of FIGS. 19 and 20.

Figure 24:
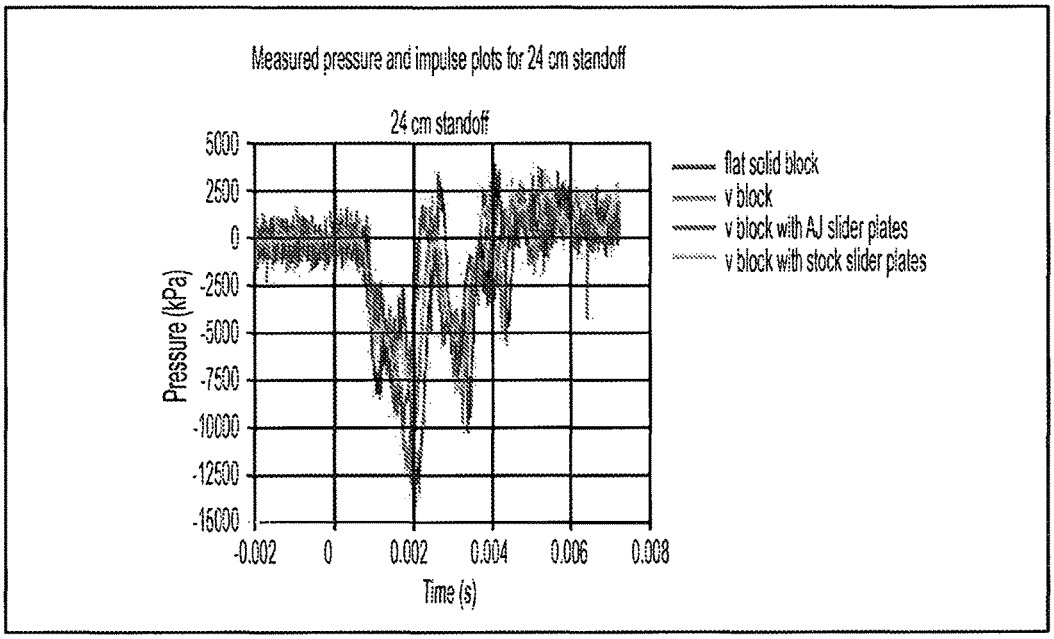
FIG. 24 is a screenshot of a graph illustrating the measured pressure for 24 cm standoff.

FIG. 24 is a screenshot of a graph illustrating the measured pressure for 24 cm standoff pertaining to the experimental setup shown in the screenshots of FIGS. 19 and 20.

Figure 25:
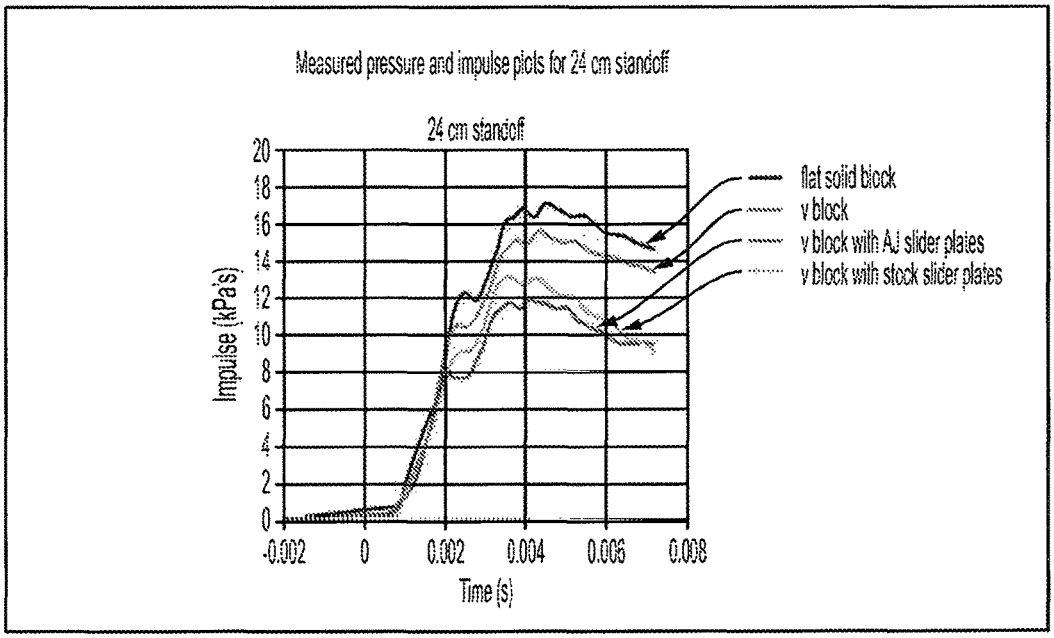
FIG. 25 is a screenshot of a graph illustrating the impulse plots for 24 cm standoff.

FIG. 25 is a screenshot of a graph illustrating the impulse plots for 24 cm standoff pertaining to the experimental setup shown in the screenshots of FIGS. 19 and 20.

Figure 26:
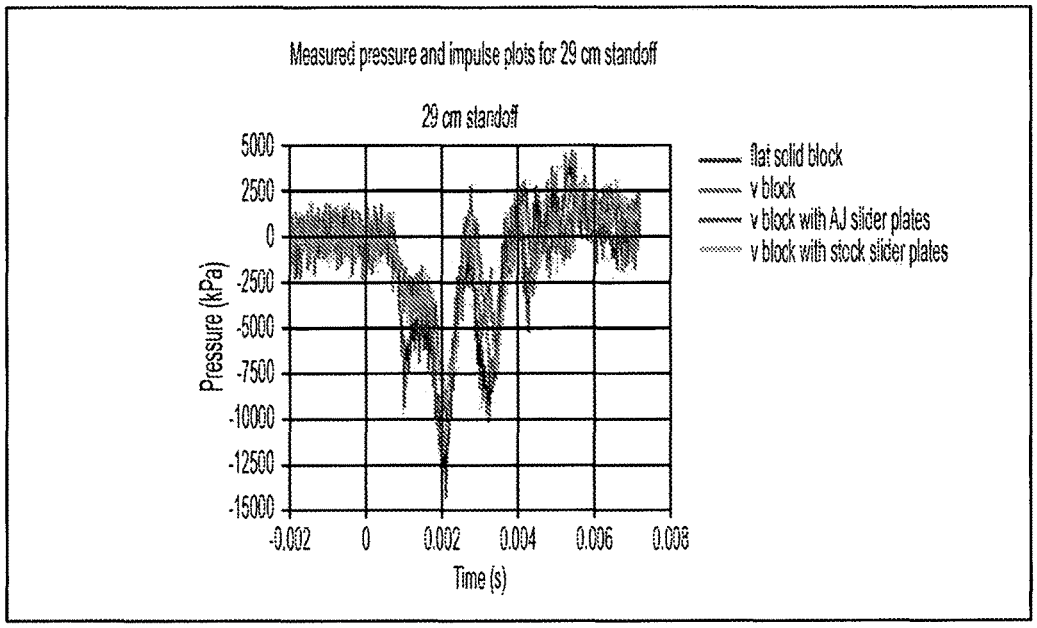
FIG. 26 is a screenshot of a graph illustrating the measure pressure for 29 cm standoff.

FIG. 26 is a screenshot of a graph illustrating the measure pressure for 29 cm standoff pertaining to the experimental setup shown in the screenshots of FIGS. 19 and 20.

Figure 27:
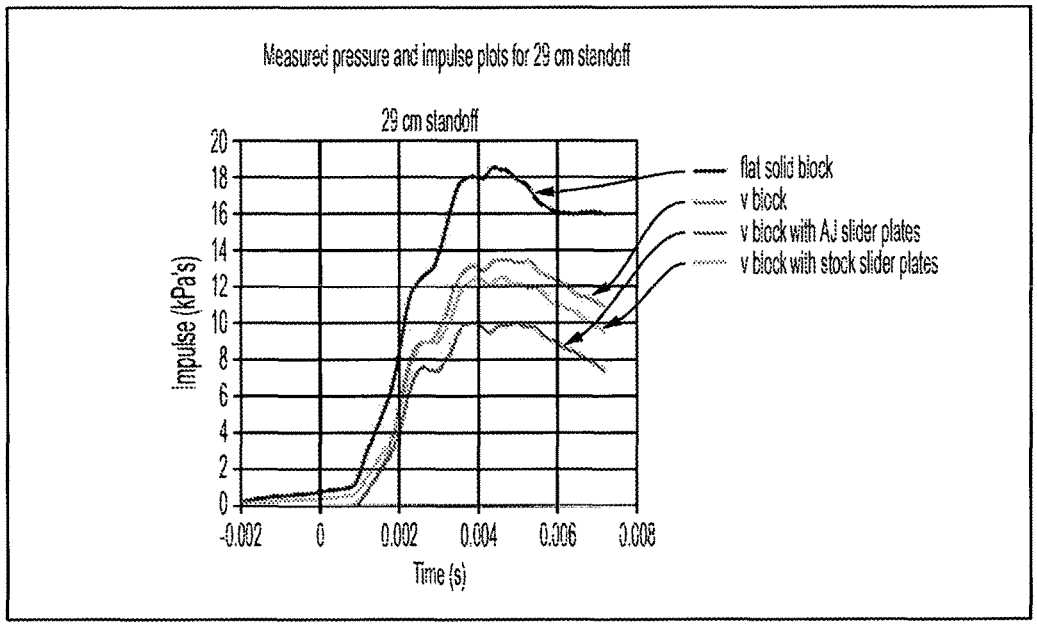
FIG. 27 is a screenshot of a graph illustrating the impulse plots for 29 cm standoff.

FIG. 27 is a screenshot of a graph illustrating the impulse plots for 29 cm standoff pertaining to the experimental setup shown in the screenshots of FIGS. 19 and 20.

It should be appreciated that various sizes, dimensions, contours, rigidity, shapes, flexibility and materials of any of the components or portions of components in the various embodiments discussed throughout may be varied and utilized as desired or required.

It should be appreciated that while some dimensions may or may not be provided on the aforementioned figures, the device may constitute various sizes, dimensions, contours, rigidity, shapes, flexibility and materials as it pertains to the components or portions of components of the device, and therefore may be varied and utilized as desired or required.

It should be appreciated that any of the components or modules referred to with regards to any of the present invention embodiments discussed herein, may be so integrally or separately formed with one another. Further, redundant functions or structures of the components or modules may be implemented.

It should be appreciated that the device and related components discussed herein may take on all shapes along the entire continual geometric spectrum of manipulation of x, y and z planes to provide and meet the structural demands and operational requirements. Moreover, locations and alignments of the various components may vary as desired or required.

The various embodiments of the structures, compositions, systems, devices, and materials discussed in the present disclosure be utilized and implemented for a number of products and services. For instance, it should be appreciated the following provides a non-limiting list of examples that represent embodiments that are considered part of the present invention and may, of course, be employed within the context of the invention other than with a V-hull (or in addition to a V-hull).

1. Heat Pipe System, structures, or devices,
2. Heat Sink system, structures, or devices,
3. Thermal Management Systems (TMS),
4. Ballistic resistant and mitigation devices, structures, and systems,
5. Projectile resistant and mitigation devices, structures, and systems,
6. Missile resistant and mitigation devices, structures, and systems,
7. Blast resistant and mitigation devices, structures, and systems,
8. Heat resistant devices, structures, and systems,
9. Electrical insulating devices, structures, and systems,
10. Armor plating system, device, or structure,
11. Tank plating system, device, or structure,
12. Armor system, device, or structure,
13. Lattice structure (for example, but not limited thereto, tetrahedral, pyramidal, three-dimension kagome, kagome, or any combination thereof).
14. Cellular structure,
15. Corrugation structure (for example, but not limited thereto, triangular, diamond, multi-layered, flat-top, Navtruss, or any combination thereof),
16. Honeycomb structure (for example, but not limited thereto, hexagonal cell, square cell, cylindrical, rectangular cell, triangular cell or any combination thereof),
17. Panel structure,
18. Face layer,
19. Sandwich structure,
20. Modular layer structure or multilayer component,
21. Multifunctional structure or component,
22. Smart memory alloy (SMA) system, device, or structure,
23. Textile weave structure, woven structure, mesh structure, braid structure, multilayer textile structure, or any combination thereof,
24. Architectural structure (for example: pillars, walls, shielding, foundations or floors for tall buildings or pillars, wall shielding floors, for regular buildings and houses),
25. Civil engineering field structure (for example: road facilities such as noise resistant walls and crash barriers, road paving materials, permanent and portable aircraft landing runways, permanent or portable landing pads, pipes, segment materials for tunnels, segment materials for underwater tunnels, tube structural materials, main beams of bridges, bridge floors, girders, cross beams of bridges, girder walls, piers, bridge substructures, towers, dikes and dams, guide ways, railroads, ocean structures such as breakwaters and wharf protection for harbor facilities, floating piers/oil excavation or production platforms, airport structures such as runways), military security/protection/defense structures;

26. Machine structure (for example: frame structures for carrying system, carrying pallets, frame structure for robots, etc.),
27. Automobile structure (for example: body, frame, doors, chassis, roof and floor, side beams, bumpers, etc.),
28. Ship structure (for example: main frame of the ship, body, deck, partition wall, wall, etc.),
29. Freight car structure (for example: body, frame, floor, wall, etc.),
30. Aircraft structure (for example: wing, main frame, body, floor, etc.),
31. Spacecraft structure (for example: body, frame, floor, wall, etc.),
32. Space station structure (for example: the main body, floor, wall, etc.), and
33. Submarine, ship or water craft structure (for example: body, frame, etc.).
34. Military vehicle (tank, automobile, robot, etc.),
35. Parts for marine vessel hulls or decks or parts for hovercraft, and other amphibious vehicles,
36. Frames to any air, space, or water craft, vehicle or robot,
37. Outer skin or inner skin, as well as other components, of any air, space, or water craft, vehicle or robot,
38. Any building structures or components of building structures,
39. Any automotive component, bodies, frames, chassis and components,
40. Transportation land, air, or sea vehicle, craft or robot,
41. Electronics systems or components of such electronic systems, as well as other components and housings,
42. Multifunctional system, device, or structure,
43. Struts or the like,
44. Jet Blast Deflector (JBD) system,
45. Armor suit (or portions thereof) for military personnel or other human or animal subjects,
46. Armor shield for military personnel or other human or animal subjects,
47. Armor helmet or mask (or portions thereof) for military personnel or other human or animal subjects,
48. Armor gear (or portions thereof) and accessories for military personnel or other human or animal subjects,
49. Armor suit for military robot or other types of robots,
50. Rods, bars or other elongated members,
51. I-beam, H-beam, or other beam like structures,
52. Impact resistant and mitigation devices, structures, and systems,
53. Force resistant and mitigation devices, structures, and systems,
54. Shock absorption devices, structures, and systems,
55. Crash deflection and mitigation devices, structures, and systems.

The method of providing, making or using any of the devices, systems, or structures provided in the above list (nos. 1-55) may be employed within the context of the invention.

EXAMPLES

Practice of an aspect of an embodiment (or embodiments) of the invention will be still more fully understood from the following examples and experimental results, which are presented herein for illustration only and should not be construed as limiting the invention in any way.

Example and Experimental Results Set No. 1

An aspect of an embodiment of the present invention provides a sliding plate system. Accordingly, an aspect of an embodiment of the present invention may provide s more significant contribution than the introduction of the V-hull to mine resistant vehicles. The V hull introduced by Vernon Joynt from S. Africa via FPI reduced momentum by 15%. In contrast, an aspect of an embodiment of the present invention slider system may achieve 25-30+%, i.e., a 200% improvement in mitigation. Also, there are consequences not just for vehicle jump height (25% impulse reduction reduces jump height by 50%), but the dynamic deflection of the interior will be greatly reduced (on top of the factor of 2-3 reduction from use of sandwich times 2× if the present inventors switch from steel to titanium, for example). Further, an aspect of an embodiment of the present invention allows the V angle to be reduced so there is more space inside the vehicle, and the vehicle height above ground could be reduced (whereby vehicle stability and stealth would be improved). Further yet, an aspect of an embodiment of the present invention provides a means to actively stabilize vehicle roll if the sliding plates were launched by a propellant when an accelerometer detected a critical roll rate.

Additional Examples

Example 1

An impulse mitigation system configured to mitigate blast impulse directed to a surface (or structure or target). The system may comprise: a substrate in communication with the surface (or structure or target), wherein the substrate configured to receive an impulse directed to the surface (or structure or target) and to relocate from the surface (or structure or target) in response to received impulse. It should be appreciated that a plurality of substrates may be implemented or utilized.

Example 2

The system of example 1, wherein the communication includes the substrate being slidably detachable with the surface.

Example 3

The system of example 1 (as well as subject matter of examples 2), wherein the surface is configured as at least two surfaces aligned to intersect one another at an angle equal to or less than 180 degrees. It should be appreciated that the angle may be any sub range less than 180 degrees. It should be appreciated that the angle may be any integer or fraction less than 180 degrees. It should be appreciated that the angle may be greater than 180 degrees (as well as any integer or fraction thereof).

Example 4

The system of example 3 (as well as subject matter of one or more of any combination of examples 2-3), wherein the substrate is in communication with a first of the at least two surfaces.

Example 5

The system of example 4 (as well as subject matter of one or more of any combination of examples 2-4), wherein the substrate is in communication with a second of the at least two surfaces.

Example 6

The system of example 1 (as well as subject matter of one or more of any combination of examples 2-5), wherein the surface is configured as at least two surfaces aligned to intersect one another at an angle equal to or less than 90 degrees. It should be appreciated that the angle may be any sub range less than 90 degrees. It should be appreciated that the angle may be any integer or fraction less than 90 degrees.

Example 7

The system of example 6 (as well as subject matter of one or more of any combination of examples 2-6), wherein the substrate is in communication with a first of the at least two surfaces.

Example 8

The system of example 7 (as well as subject matter of one or more of any combination of examples 2-7), wherein the substrate is in communication with a second of the at least two surfaces.

Example 9

The system of example 1 (as well as subject matter of one or more of any combination of examples 2-8), wherein the relocation of the substrate includes sliding along the surface.

Example 10

The system of example 1 (as well as subject matter of one or more of any combination of examples 2-9), wherein the substrate comprises a material including one or more of any combination of the following materials: cermet, ceramic, or metal bonded ceramic.

Example 11

The system of example 1 (as well as subject matter of one or more of any combination of examples 2-10), wherein the relocation of the substrate includes breaking apart from the surface.

Example 12

The system of example 1 (as well as subject matter of one or more of any combination of examples 2-11), wherein the surface comprises a sandwich panel.

Example 13

The system of example 1 (as well as subject matter of one or more of any combination of examples 2-12), wherein the substrate comprises a sandwich panel.

Example 14

The system of example 1 (as well as subject matter of one or more of any combination of examples 2-13), wherein the surface is configured as part of a chassis to be used for a transportation vehicle, transportation container or transportation craft.

Example 15

The system of example 1 (as well as subject matter of one or more of any combination of examples 2-14), wherein the surface is configured as part of a body to be used for a transportation vehicle, transportation container or transportation craft.

Example 16

The system of example 1 (as well as subject matter of one or more of any combination of examples 2-15), wherein the surface is configured as part of a chassis and body to be used for a transportation vehicle, transportation container or transportation craft.

Example 17

The system of example 1 (as well as subject matter of one or more of any combination of examples 2-16), wherein the surface is configured as part of a non-transportation structure, system, or device.

Example 18

The system of example 1 (as well as subject matter of one or more of any combination of examples 2-17), wherein the system further comprises: a chassis to a transportation vehicle, transportation container or transportation craft; and wherein the surface is configured as part of the chassis.

Example 19

The system of example 1 (as well as subject matter of one or more of any combination of examples 2-18), wherein the system further comprises: a body to a transportation vehicle, transportation container or transportation craft; and wherein the surface is configured as part of the body.

Example 20

The system of example 1 (as well as subject matter of one or more of any combination of examples 2-19), wherein the system further comprises: a chassis and body to a transportation vehicle, transportation container or transportation craft; and wherein the surface is configured as part of the chassis and the body.

Example 21

The system of example 1 (as well as subject matter of one or more of any combination of examples 2-20), wherein the system further comprises: a transportation vehicle, transportation container or transportation craft. The transportation vehicle, transportation container or transportation craft comprises: a chassis; and wherein the surface is configured as part of the chassis.

Example 22

The system of example 1 (as well as subject matter of one or more of any combination of examples 2-21), wherein the system further comprises: a transportation vehicle, transportation container or transportation craft. The transportation vehicle, transportation container or transportation craft comprises: a body; and wherein the surface is configured as part of the body.

Example 23

The system of example 1 (as well as subject matter of one or more of any combination of examples 2-22), wherein the system further comprises: a transportation vehicle, transportation container or transportation craft. The transportation vehicle, transportation container or transportation craft comprises: a chassis and body; and wherein the surface is configured as part of the chassis and the body.

Example 24

A method of making an impulse mitigation system configured to mitigate blast impulse directed to a surface (or structure or target). The method may comprise: providing a substrate in communication with the surface (or structure or target); configuring the substrate for receiving an impulse directed to the surface (or structure or target); and configuring the substrate to relocate from the surface (or structure or target) upon receipt of the directed impulse.

Example 25

The method of manufacturing any of the systems (or components or portions of the systems) provided in any one or more of examples 1-23. The method of manufacturing may utilize any of the techniques, materials, compositions, components, structures, approaches, devices, or systems disclosed in references cited herein (i.e. the references being the various patents, applications and publications as listed herein).

Example 26

The method of using any of the systems (or components or portions of the systems) provided in any one or more of examples 1-23. The method of using may utilize any of the techniques, materials, compositions, components, structures, approaches, devices, or systems disclosed in references cited herein (i.e. the references being the various patents, applications and publications as listed herein).

REFERENCES

The following patents, applications and publications as listed below and throughout this document are hereby incorporated by reference in their entirety herein. It should be appreciated that various aspects of embodiments of the present method, system, devices, article of manufacture, and compositions may be implemented with the following methods, systems, devices, article of manufacture, and compositions disclosed in the following U.S. Patent Applications, U.S. Patents, Publications, and PCT International Patent Applications and are hereby incorporated by reference herein and co-owned with the assignee (and which are not admitted to be prior art with respect to the present invention by inclusion in this section): International Patent Application Serial No. PCT/US2015/025774, Wadley, et al., "Graphene or Carbon Nanotube Materials and Method of Making and Using the Same", filed Apr. 14, 2015.

International Patent Application Serial No. PCT/US2015/025736, Wadley, et al., "Hierarchical Cellular Materials and Method of Making and Using the Same", filed Apr. 14, 2015.

International Patent Application Serial No. PCT/US2014/052899, Wadley, et al., "Lattice Materials and Structures and Related Methods Thereof", filed Aug. 27, 2014.

International Patent Application Serial No. PCT/US2014/052936, Wadley, et al., "Three-Dimensional Space Frames Assembled from Component Pieces and Methods for Making the Same", filed Aug. 27, 2014.

International Patent Application No. PCT/US2014/033821 entitled "Corrosion Resistant Metal and Metal Alloy Coatings Containing Supersaturated Concentrations of Corrosion Inhibiting Elements and Methods and Systems for Making the Same," filed Apr. 11, 2014.

U.S. patent application Ser. No. 13/640,259 entitled "Multi-Functional Hybrid Panel for Blast and Impact Mitigation and Method of Manufacture," filed Oct. 9, 2012; U.S. Patent Application Publication No. 2013/0263727, Oct. 10, 2013.

International Patent Application No. PCT/US2011/031592 entitled "Multi-Functional Hybrid Panel for Blast and Impact Mitigation and Method of Manufacture," filed Apr. 7, 2011.

U.S. patent application Ser. No. 13/522,264 entitled "Multifunctional Thermal Management System and Related Method," filed Jul. 13, 2012; U.S. Patent Application Publication No. 2013/0014916, Jan. 17, 2013.

International Patent Application No. PCT/US2011/1021121 entitled "Multifunctional Thermal Management System and Related Method," filed Jan. 13, 2011.

U.S. patent application Ser. No. 13/448,074 entitled "Manufacture of Lattice Truss Structures from Monolithic Materials," filed Apr. 16, 2012.

U.S. patent application Ser. No. 12/447,166 entitled "Manufacture of Lattice Truss Structures from Monolithic Materials," filed Apr. 24, 2009; U.S. Pat. No. 8,176,635, issued May 15, 2012.

International Patent Application No. PCT/US2007/022733 entitled "Manufacture of Lattice Truss Structures from Monolithic Materials," filed Oct. 26, 2007.

U.S. patent application Ser. No. 13/371,044 entitled "Method and Apparatus Application of Metallic Alloy Coatings." filed Feb. 10, 2012.

U.S. patent application Ser. No. 10/489,090 entitled "Method and Apparatus Application of Metallic Alloy Coatings," filed Mar. 9, 2004; U.S. Pat. No. 8,124,178, issued Feb. 28, 2012.

International Patent Application No. US02/28654 entitled "Method and Apparatus for Application of Metallic Alloy Coatings," filed Sep. 10, 2002.

U.S. patent application Ser. No. 13/337,133 entitled "Reliant Thermal Barrier Coating System and Related Methods and Apparatus of Making the Same," filed Dec. 25, 2011; U.S. Patent Application Publication No. 2012/0160166, Jun. 28, 2012.

U.S. patent application Ser. No. 11/917,585 entitled "Reliant Thermal Barrier Coating System and Related Methods and Apparatus of Making the Same," filed Dec. 14, 2007; U.S. Pat. No. 8,084,086, issued Dec. 27, 2011.

International Patent Application No. US2006/025978 entitled "Reliant Thermal Barrier Coating System and Related Methods and Apparatus of Making the Same," filed Jun. 30, 2006.

U.S. patent application Ser. No. 13/202,828 entitled "Coaxial Hollow Cathode Plasma Assisted Directed Vapor Deposition and Related Method Thereof;" filed Aug. 23, 2011; U.S. Patent Application Publication No. 2011/0318498, Dec. 29, 2011.

International Patent Application No. PCT/US2010/025259 entitled "Coaxial Hollow Cathode Plasma Assisted Directed Vapor Deposition and Related Method Thereof," filed Feb. 24, 2010.

U.S. patent application Ser. No. 13/164,189 entitled "Multifunctional Periodic Cellular Solids and the Method of Making the Same," filed Jun. 20, 2011.

U.S. patent application Ser. No. 10/479,833 entitled "Multifunctional Periodic Cellular Solids and the Method of Making the Same," filed Dec. 5, 2003; U.S. Pat. No. 7,963,085, issued Jun. 21, 2011.

International Patent Application No. PCT/US2002/017942 entitled "Multifunctional Periodic Cellular Solids and the Method of Making the Same," filed Jun. 6, 2002.

International Patent Application No. PCT/US2011/035581 entitled "Spotless Arc Directed Vapor Deposition (SA-DVD) and Related Method Thereof," filed May 6, 2011.

U.S. patent application Ser. No. 12/733,160 entitled "Thin Film Battery Synthesis by Directed Vapor Deposition," filed Feb. 16, 2010; U.S. Pat. No. 8,784,512, issued Jul. 22, 2014.

International Patent Application No. PCT/US2008/073071 entitled "Thin Film Battery Synthesis by Directed Vapor Deposition," filed Aug. 13, 2008.

U.S. patent application Ser. No. 12/673,647 entitled "Synergistically-Layered Armor Systems and Methods for Producing Layers Thereof," filed Feb. 16, 2010.

International Patent Application No. PCT/US2008/073377 entitled "Synergistically-Layered Armor Systems and Methods for Producing Layers Thereof," filed Aug. 15, 2008.

U.S. patent application Ser. No. 12/673,418 entitled "Hybrid Periodic Cellular Material Structures, Systems, and Methods for Blast and Ballistic Protection," filed Feb. 12, 2010.

International Patent Application No. PCT/US2008/071848 entitled "Hybrid Periodic Cellular Material Structures, Systems, and Methods for Blast and Ballistic Protection," filed Jul. 31, 2008.

International Patent Application No. PCT/US2009/061888 entitled "Reactive Topologically Controlled Armors for Protection and Related Method," filed Oct. 23, 2009.

U.S. patent application Ser. No. 12/604,654 entitled "Interwoven Sandwich Panel Structures and Related Method Thereof," filed Oct. 23, 2009.

U.S. patent application Ser. No. 12/596,548 entitled "Heat-Managing Composite Structures," filed Oct. 19, 2009; U.S. Patent Application Publication No. 2010/0236759, Sep. 23, 2010.

International Patent Application No. PCT/US2008/060637 entitled "Heat-Managing Composite Structures," filed Apr. 17, 2008.

U.S. patent application Ser. No. 12/301,916 entitled "Method and Apparatus for Jet Blast Deflection," filed Oct. 7, 2009; U.S. Pat. No. 8,360,361, issued Jan. 29, 2013.

International Patent Application No. PCT/US2007/012268 entitled "Method and Apparatus for Jet Blast Deflection," filed May 23, 2007.

U.S. patent application Ser. No. 12/479,408 entitled "Manufacture of Lattice Truss Structures from Monolithic Materials," filed Jun. 5, 2009; U.S. Pat. No. 8,650,756, issued Feb. 18, 2014.

U.S. patent application Ser. No. 12/408,250 entitled "Cellular Lattice Structures With Multiplicity of Cell Sizes and Related Method of Use," filed Mar. 20, 2009.

International Patent Application No. PCT/US2009/034690 entitled "Method for Manufacture of Cellular Structure and Resulting Cellular Structure," filed Feb. 20, 2009.

U.S. patent application Ser. No. 11/928,161 entitled "Method and Apparatus for Heat Exchange Using Hollow Foams and Interconnected Networks and Method of Making the Same," filed Oct. 30, 2007.

U.S. patent application Ser. No. 10/333,004 entitled "Heat Exchange Foam," filed Jan. 14, 2003; U.S. Pat. No. 7,401,643, issued Jul. 22, 2008.

International Patent Application No. PCT/US2001/022266 entitled "Method and Apparatus for Heat Exchange Using Hollow Foams and Interconnected Networks and Method of Making the Same," filed Jul. 16, 2001.

U.S. patent application Ser. No. 11/857,856 entitled "Active Energy Absorbing Cellular Metals and Method of Manufacturing and Using the Same," filed Sep. 19, 2007.

U.S. patent application Ser. No. 10/516,052 entitled "Active Energy Absorbing Cellular Metals and Method of Manufacturing and Using the Same," filed Nov. 29, 2004; U.S. Pat. No. 7,288,326, issued Oct. 30, 2007.

International Patent Application No. US2003/017049 entitled "Active Energy Absorbing Cellular Metals and Method of Manufacturing and Using the Same," filed May 30, 2003.

U.S. patent application Ser. No. 11/788,958 entitled "Multifunctional Battery and Method of Making the Same," filed Apr. 23, 2007; U.S. Patent Application Publication No. 2007/0269716, Nov. 22, 2007.

U.S. patent application Ser. No. 10/110,368 entitled "Multifunctional Battery and Method of Making the Same," filed Apr. 9, 2002; U.S. Pat. No. 7,211,348, issued May 1, 2007.

International Patent Application No. PCT/US2001/025158 entitled "MULTIFUNCTIONAL BATTERY AND METHOD OF MAKING THE SAME," filed Aug. 10, 2001.

U.S. patent application Ser. No. 10/584,682 entitled "Apparatus and Method for Applying Coatings onto the Interior Surfaces of Components and Related Structures Produced Therefrom," filed Jun. 28, 2006; U.S. Pat. No. 8,110,143, issued Feb. 7, 2012.

International Patent Application No. US2005/000606 entitled "Apparatus and Method for Applying Coatings onto the Interior Surfaces of Components and Related Structures Produced Therefrom," filed Jan. 10, 2005.

U.S. patent application Ser. No. 10/566,316 entitled "Method for Application of a Thermal Barrier Coating and Resultant Structure Thereof" filed Jan. 27, 2006.

International Patent Application No. US2004/024232 entitled "Method for Application of a Thermal Barrier Coating and Resultant Structure Thereof," filed Jul. 28, 2004.

U.S. patent application Ser. No. 10/545,042 entitled "Methods for Manufacture of Multilayered Multifunctional Truss Structures and Related Structures Therefrom," filed Aug. 11, 2005.

International Patent Application No. PCT/US2004/004608 entitled "Methods for Manufacture of Multilayered Multifunctional Truss Structures and Related Structures Therefrom," filed Feb. 17, 2004.

U.S. patent application Ser. No. 10/535,364 entitled "Bond Coat for a Thermal Barrier Coating System and Related Method Thereof," filed May 18, 2005.

International Patent Application No. US2003/037485 entitled "Bond Coat for a Thermal Barrier Coating System and Related Method Thereof;" filed Nov. 21, 2003.

U.S. patent application Ser. No. 10/533,993 entitled "Extremely Strain Tolerant Thermal Protection Coating and Related Method and Apparatus Thereof," filed May 5, 2005.

International Patent Application No. US2003/036035 entitled "Extremely Strain Tolerant Thermal Protection Coating and Related Method and Apparatus Thereof," filed Nov. 12, 2003.

U.S. patent application Ser. No. 10/526,416 entitled "Blast and Ballistic Protection Systems and Methods of Making Same," filed Mar. 2, 2005; U.S. Pat. No. 7,913,611, issued Mar. 29, 2011.

International Patent Application No. US2003/027605 entitled "Blast and Ballistic Protection Systems and Methods of Making Same," filed Sep. 3, 2003.

U.S. patent application Ser. No. 10/526,296 entitled "Method for Manufacture of Truss Core Sandwich Structures and Related Structures Thereof," filed Mar. 1, 2005; U.S. Pat. No. 7,424,967, issued Sep. 16, 2008.

International Patent Application No. US2003/027606 entitled "Method for Manufacture of Truss Core Sandwich Structures and Related Structures Thereof;" filed Sep. 3, 2003.

U.S. patent application Ser. No. 10/522,068 entitled "Method for Manufacture of Cellular Materials and Structures for Blast and Impact Mitigation and Resulting Structure," filed Jan. 21, 2005.

International Patent Application No. PCT/US2003/023043 entitled "Method for Manufacture of Cellular Materials and Structures for Blast and Impact Mitigation and Resulting Structure," filed Jul. 23, 2003.

U.S. patent application Ser. No. 10/522,076 entitled "Method and Apparatus for Dispersion Strengthened Bond Coats for Thermal Barrier Coatings," filed Jan. 21, 2005.

International Patent Application No. US2003/023111 entitled "Method and Apparatus for Dispersion Strengthened Bond Coats for Thermal Barrier Coatings," filed Jul. 24, 2003.

U.S. patent application Ser. No. 10/515,572 entitled "Method for Manufacture of Periodic Cellular Structure and Resulting Periodic Cellular Structure," filed Nov. 23, 2004.

International Patent Application No. PCT/US2003/016844 entitled "Method for Manufacture of Periodic Cellular Structure and Resulting Periodic Cellular Structure," filed May 29, 2003.

U.S. patent application Ser. No. 10/512,161 entitled "Apparatus and Method for Uniform Line of Sight and Non-Line of Sight Coating at High Rate," filed Oct. 15, 2004; U.S. Pat. No. 7,718,222, issued May 18, 2010.

International Patent Application No. US2003/012920 entitled "Apparatus and Method for Uniform Line of Sight and Non-Line of Sight Coating at High Rate," filed Apr. 25, 2003.

U.S. patent application Ser. No. 10/487,291 entitled "Reversible Shape Memory Multifunctional Structural Designs and Method of Using and Making the Same," filed Feb. 20, 2004; U.S. Pat. No. 7,669,799, issued Mar. 2, 2010.

International Patent Application No. US02/27116 entitled "Reversible Shape Memory Multifunctional Structural Designs and Method of Using and Making the so Same," filed Aug. 26, 2002.

U.S. patent application Ser. No. 10/476,309 entitled "Method and Apparatus for Efficient Application of Substrate Coating," filed Oct. 29, 2003; U.S. Pat. No. 7,879,411, issued Feb. 1, 2011.

International Patent Application No. PCT/US2002/013639 entitled "Method and Apparatus for Efficient Application of Substrate Coating," filed Apr. 30, 2002.

U.S. patent application Ser. No. 10/296,728 entitled "Multifunctional Periodic Cellular Solids and the Method of Making Thereof," filed Nov. 25, 2002; U.S. Pat. No. 8,247,333, issued Aug. 21, 2012.

International Patent Application No. PCT/US2001/017363 entitled "Multifunctional Periodic Cellular Solids and the Method of Making Thereof," filed May 29, 2001.

U.S. patent application Ser. Ser. No. 10/297,347 entitled "Process and Apparatus for Plasma Activated Deposition in a Vacuum," filed Nov. 21, 2002; U.S. Pat. No. 7,014,889, issued Mar. 21, 2006.

International Patent Application No. US01/16693 entitled "A Process and Apparatus for Plasma Activated Deposition In Vacuum," filed May 23, 2001.

U.S. patent application Ser. No. 10/246,018 entitled "Apparatus and Method for Intra-layer Modulation of the Material Deposition and Assist Beam and the Multilayer Structure Produced Therefrom," filed Sep. 18, 2002.

U.S. patent application Ser. No. 09/634,457 entitled "Apparatus and Method for Intra-Layer Modulation of the Material Deposition and Assist Beam and the Multilayer Structure Produced Therefrom," filed Aug. 7, 2000.

International Patent Application No. US99/13450 entitled "Apparatus and Method for Producing Thermal Barrier Coatings," filed Jun. 15, 1999.

International Patent Application No. US97/11185 entitled "Production of Nanometer Particles By Directed Vapor Deposition of Electron Beam Evaporant," filed Jul. 8, 1997.

U.S. patent application Ser. No. 08/679,435 entitled "Production of Nanometer Particles by Directed Vapor Deposition of Electron Beam Evaporant," filed Jul. 8, 1996; U.S. Pat. No. 5,736,073, issued Apr. 7, 1998.

U.S. patent application Ser. No. 08/298,614 entitled "Directed Vapor Deposition of Electron Beam Evaporant," filed Aug. 31, 1994; U.S. Pat. No. 5,534,314, issued Jul. 9, 1996.

U.S. Pat. No. 7,357,062 B2, Joynt, V., "Mine Resistant Armored Vehicle", Apr. 15, 2008.

U.S. Pat. No. 8,146,478 B2, Joynt, V., at al., "Mine Resistant Armored Vehicle", Apr. 3, 2012.

Entitled, "Vehicle with structural vent channels for blast energy and debris dissipation," Publication No. US 2012/0193940 A1; Publication date Aug. 2, 2012; Application No. U.S. Ser. No. 13/066,243, filing date Apr. 8, 2011.

In summary, while the present invention has been described with respect to specific embodiments, many modifications, variations, alterations, substitutions, and equivalents will be apparent to those skilled in the art. The present invention is not to be limited in scope by the specific embodiment described herein. Indeed, various modifications of the present invention, in addition to those described herein, will be apparent to those of skill in the art from the foregoing description and accompanying drawings. Accordingly, the invention is to be considered as limited only by the spirit and scope of the following claims, including all modifications and equivalents.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Unless clearly specified to the contrary, there is no requirement for any particular described or illustrated activity or element, any particular sequence or such activities, any particular size, speed, material, dimension or frequency, or any particularly interrelationship of such elements. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all sub ranges therein. Any information in any material (e.g., a United States/foreign patent, United States/foreign patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

We claim:

1. An impulse mitigation system of a V-hull structure configured to mitigate a blast impulse from a blast impulse source directed to a left surface and right surface of the V-hull structure from the exterior, wherein said system comprises:

a left side sliding substrate and right side sliding substrate that are in communication and parallel with the left side V-hull structure surface and right side V-hull structure surface, respectively, wherein said left sliding substrate and right side sliding substrate are configured to receive the blast impulse from the exterior directed to the left side V-hull structure surface and right side V-hull structure surface and to relocate from the left side sliding substrate and right side sliding substrate in response to the received blast impulse;

wherein said communication includes the left sliding substrate and right side sliding substrate being slidably detachable with the left side V-hull structure surface and right side V-hull structure surface, respectively;

wherein the relocation of the entire left side sliding substrate and entire right side sliding substrate are in a direction parallel to the left side V-hull structure surface and right side V-hull structure surface, respectively; and wherein the relocation of said left side sliding substrate and right side sliding substrate includes:

sliding along the left side V-hull structure surface and right side V-hull structure surface, respectively, away from the blast impulse source, and sliding away from one another so as separate and detach from the left side V-hull structure surface and right side V-hull structure surface, respectively.

2. The system of claim 1, wherein said left side V-hull structure surface and right side V-hull structure surface are configured as at least two structure surfaces aligned to intersect one another at an angle equal to or less than 165 degrees.

3. The system of claim 1, wherein said left side V-hull structure surface and right side V-hull structure surface are configured as at least two structure surfaces aligned to intersect one another at an angle equal to or less than 150 degrees.

4. The system of claim 1, wherein said left side V-hull structure surface and right side V-hull structure surface are configured as at least two structure surfaces aligned to intersect one another at an angle equal to or less than 135 degrees.

5. The system of claim 1, wherein said left-side V-hull structure surface and right side V-hull structure are configured as at least two structure surfaces aligned to intersect one another at an angle equal to or less than 90 degrees.

6. The system of claim 1, wherein said left side V-hull structure surface and right side V-hull structure surface are configured as at least two structure surfaces aligned to intersect one another at an angle equal to or less than 120 degrees.

7. The system of claim 1, wherein said left side V-hull structure surface and right side V-hull structure surface are configured as at least two structure surfaces aligned to intersect one another at an angle equal to or less than 105 degrees.

8. The system of claim 1, wherein said at least one of said left side sliding substrate and right side sliding substrate comprises a material including one or more of any combination of the following materials: cermet, ceramic, or metal bonded ceramic.

9. The system of claim 1, wherein at least one of said left side V-hull structure surface and right side V-hull structure surface comprises a sandwich panel.

10. The system of claim 1, wherein at least one of said left side sliding substrate and right side sliding substrate comprises a sandwich panel.

11. The system of claim 1, wherein at least one of the left side V-hull structure surface and right side V-hull structure surface is configured as part of a chassis to be used for a transportation vehicle, transportation container or transportation craft.

12. The system of claim 1, wherein at least one of the left side V-hull structure surface and right side V-hull structure surface is configured as part of a body to be used for a transportation vehicle, transportation container or transportation craft.

13. The system of claim 1, wherein at least one of the left side V-hull structure surface and right side V-hull structure is configured as part of a chassis and body to be used for a transportation vehicle, transportation container or transportation craft.

14. The system of claim 1, wherein at least one of the left side V-hull structure surface and right side V-hull structure is configured as part of a non-transportation structure, system, or device.

15. A method of making an impulse mitigation system of a V-hull structure configured to mitigate a blast impulse from a blast impulse source directed to a left surface and right surface of the V-hull structure from the exterior, wherein said method comprises:

providing a left sliding substrate and right sliding substrate that are in communication and parallel with the left V-hull structure surface and right V-hull structure surface, respectively, and wherein said communication includes the left sliding substrate and right side sliding substrate being slidably detachable with the left side V-hull structure surface and right side V-hull structure surface, respectively;

configuring said left side sliding substrate and right side sliding substrate for receiving an impulse from the exterior directed to the left side V-hull structure surface and right side V-hull structure surface;

configuring said left side sliding substrate and right side sliding substrate to relocate from the left V-hull structure surface and right V-hull structure surface upon receipt of the directed impulse;

wherein the relocation of the entire left side sliding substrate and right side sliding substrate is in a direction parallel to the structure surface; and wherein the relocation of said left side sliding substrate and right side sliding substrate includes:

sliding along the left side V-hull structure surface and right side V-hull structure, respectively, away from the blast impulse source, and sliding away from one another so as separate and detach from the left side V-hull structure surface and right side V-hull structure surface, respectively.

* * * * *